US005823838A

United States Patent [19]

Darcy et al.

[11] Patent Number: 5,823,838

[45] Date of Patent: Oct. 20, 1998

[54] LIFE-JACKET

[75] Inventors: Roderick Gerard Darcy, Greystones; Aidan Kelly, Delgany Co Wicklow, both of Ireland

[73] Assignee: O'Dare International Limited, Bray, Ireland

[21] Appl. No.: 655,193

[22] Filed: May 28, 1996

[51] Int. Cl.[6] ..... B63C 9/08

[52] U.S. Cl. ..... 441/106; 441/115

[58] Field of Search ..... 441/88, 102, 103–112, 441/114, 115, 116, 117, 118, 119

[56] References Cited

U.S. PATENT DOCUMENTS

| | | | |
|---|---|---|---|
| 1,308,561 | 7/1919 | Teeters | 441/104 |
| 1,842,653 | 1/1932 | Black et al. . | |
| 2,618,257 | 11/1952 | Berkman . | |
| 2,629,118 | 2/1953 | Frieder et al. . | |
| 3,076,206 | 2/1963 | Shaw et al. | 441/104 |
| 3,266,069 | 8/1966 | O'Link . | |
| 4,281,428 | 8/1981 | Rochlin . | |

FOREIGN PATENT DOCUMENTS

| | | | |
|---|---|---|---|
| N25945 | 5/1914 | United Kingdom . | |
| 1576765 | 10/1990 | United Kingdom | 441/111 |

*Primary Examiner*—Jesus D. Sotelo

*Attorney, Agent, or Firm*—Jacobson, Price, Holman & Stern, PPLC

[57] ABSTRACT

The invention provides a life-jacket which takes account of the articulation zones of a wearer's body, namely those parts of the upper torso that bend, twist and flex when engaged in maritime activities. This is done by providing a life-jacket having buoyancy material with articulation zones in it which are coincident with a wearer's articulation zone. One particularly suitable form of life-jacket may incorporate a sailing trousers. The life-jacket (1) has an upper body garment which has seven front pockets (10, 11, 12 and 13) on each side of a front opening (4), namely lower pockets (10 intermediate pockets (11), chest pockets (12) and a shoulder pocket (13) defining a waist articulation zone (20), an underneath ribs articulation zone (21), a mid-ribs to armpit articulation zone (22), a below collar bone to a top of the shoulder articulation zone (24). Each pocket contains suitable buoyancy material. Further pockets are placed on the back of the life-jacket (1). The invention also provides a sailing suit and a method of manufacturing a life-jacket.

18 Claims, 13 Drawing Sheets

LIFE-JACKET

INTRODUCTION

The present invention relates to safety equipment for marine use and in particular to life-jackets and buoyancy aids, hereinafter referred to collectively where the context permits as life-jackets and additionally to garments for general maritime use.

The term "life-jacket" and "buoyancy aid" are terms that often cause confusion because the distinction between these terms in Ireland and the United Kingdom is a distinction between a buoyancy aid which is considered to be something that keeps you afloat and a life-jacket which in addition to keeping you afloat, namely as a flotation aid will turn you face upwards as well. However, in other countries, the term "life-jacket" is used for essentially the same construction of aid as for a buoyancy aid.

There are no less than four European Standards for life-jackets and personal buoyancy aids. These are EN393 for buoyancy aids up to 50 Newtons, EN395 for life-jackets of 100 Newtons, EN396 for life-jackets of 150 Newtons and EN399 for life-jackets of 275 Newtons. A Newton is a measured unit of force and ten units are approximately equivalent to 1 kg of buoyancy. The higher the Newton number the higher the buoyancy rating. Thus, the 50 Newton buoyancy aid is considered to be only suitable for competent swimmers and then there are various degrees of buoyancy given. But even for the 275 Newton life-jacket, these cannot be guaranteed to self-right an unconscious user wearing heavy clothing. The buoyancy they provide ensures that they should provide this self-righting and as mentioned above this conflict between Ireland, the United Kingdom and the rest of Europe has not by any means been resolved. However, it is very instructive to read some of the comments in for example EN393 where it is stated that while buoyancy aids should only be used in situations where there is little risk of incapacitation the reason for preferring a buoyancy aid in such circumstances should be when the added bulk of a life-jacket would restrict or impede the activity to be undertaken or even create added risk such as in the case of dinghy sailors who may, if they use life jackets, become trapped in a capsized boats or of canoeists who may not be able to conduct themselves safely on the water with anything more bulky.

One of the things that prompted the present applicants to consider this whole problem is the very telling statement made in this European Standard EN393, where it is stated that equally essential is the need for the designer to encourage the wearing of the equipment by making it comfortable and attractive for continuous wear on or near the water. The main reason, they maintain, for having a standard for a life-jacket or buoyancy aid with as low a buoyancy as 50 Newtons is the recognition that comfort and mobility are important factors in determining whether or not buoyancy aids are worn. It goes on to make certain comments about buoyancy aids that are equally applicable to life-jackets in that they should provide a sufficient degree of buoyancy in a garment which is light in weight, not unnecessarily bulky and allows freedom of movement. It should be secure in wear, providing positive support in the water, allowing the wearer to swim or actively assist himself or others. Indeed, it is obvious from reading these European Standards that the European Committee for Standardization were well aware of the need to provide more efficient life-jackets, but they equally appreciated the necessity for a compromise between what was desirable at one level in relation to life saving and flotation and what was equally likely to be worn by the user. This is discussed in more detail below.

In this specification the term "maritime" is loosely used to indicate all water and shore based activities with fresh or sea water or even industrial activities where liquids are being handled and there is a need for operatives to wear life-jackets. Thus, such activities may be commercial, leisure, military, conservationist or educational.

The term "boating" is a general term used in the specification to include but not exclusively, sailing whether racing or cruising in keel boats and dinghies, canoeing, motor-boating, fishing and the like maritime activities.

Similarly the term "sailing" when used in the general sense includes all boating activities as hereinbefore defined and for example, a reference to a "sailing suit" includes inter alia a reference to a suit for use in all boating activities referred to above and this would cover suits for commercial shipping, fisherman's work suits, survival or anti-exposure clothing for, for example, arctic conditions and so on. These and other terms have been used in this specification because of their general descriptiveness and not to be in any way considered as limiting the generality of their application.

There are major problems with all known forms of life-jacket and particularly with life-jackets of the type comprising an upper body garment containing a quantity of buoyancy material, which is the more regular form of life-jacket, the other form of life-jacket being an inflatable life-jacket which operates in substantially the same way as an air bag. There are types of such inflatable life-jackets which are automatically inflatable on contact with water. One of the major problems with these automatically inflatable life-jackets is that they can inadvertently inflate in situations where it is not required. For example, excessive amount of spray or water contacting the life-jacket can cause it to inflate. Indeed this is one of the reasons that many people will not wear them, because they inflate inadvertently and can be positively dangerous when people are working on tasks around a boat such as those carried our by a foredeck hand while racing.

There are numerous suppliers of life-jackets of the type referred to already which comprise an upper body garment containing a quantity of buoyancy material. But as one brochure produced by a prominent manufacturer of sea-gear, namely, Helly Hansen, stated in their 1995 catalogue it is virtually impossible to force everyone to use a life-jacket. In a further telling comment they state that people gladly spend a fortune on a boat to enjoy their life and why not spend a small sum to save it? They go on to remark unnecessarily that the majority of those who drown from leisure boats are not wearing a life-jacket. They suggest that this basically is because most accidents occur in situations in which people feel safe, close to the coast in calm waters. They make the very strong point that if you are going to be safe at sea, you must wear a life-jacket.

Generally speaking, what happens is such life-jackets are worn on top of oilskin trousers and jackets or oilskin suits and therefore form a very bulky garment. One of the reasons why people do not wear life-jackets is that they are bulky and restrict their movement and this fact has been long appreciated by the manufacturers of such life-jackets and they have all made claims at various times to the fact that their life-jackets do indeed give freedom of movement. There are claims in many of the brochures that they allow complete freedom of movement. Most of the effort to allow such freedom of movement has concentrated on cutting the garment to allow freedom of arm movement or to splitting the panels forming the life-jacket either once vertically or once horizontally. There is one construction of such a life jacket with a number of separate vertically arranged panels. This latter construction being particularly attractive to women. However, these splits have been largely arbitrarily chosen. Manufacturers of life-jackets maintain that their cut of panelling of the buoyancy materials allows freedom of movement or that the buoyancy material used within the life-jacket is sufficiently soft to allow freedom of movement. Such claims unfortunately cannot be maintained. Where they are worn as well as their inherent construction adds to the constriction of movement for most wearers.

The major problem that has been envisaged by manufacturers is this lack of desire of many people to wear them because of their bulkiness. Therefore, many manufacturers have produced what is effectively a buoyancy jacket-like garment with sleeves, incorporating sufficient buoyancy material in the lining to provide a reasonable amount of buoyancy when somebody falls into the water. Unfortunately, there are problems with such jackets in that they generally are opened when somebody falls into the water and they often float away from the unfortunate person. They are, even when correctly worn, almost impossible to swim in. These are somewhat similar to the commercial anti-exposure gear referred to below.

As has been envisaged and mentioned already in respect of the European Standards, the added bulk can restrict or impede the activity to be undertaken or even cause added danger risk of problem. Thus, it is not entirely carelessness and inattention to safety that causes many a life-jacket to be discarded and not worn.

There is a further problem that has heretofore not been given enough attention and that is the problem of kidney trauma which is a general problem in many sports and is a particular problem in sailing where it is vital to protect kidneys from chilling and from knocks. Since such life-jackets contain a quantity of buoyancy material, the closer that buoyancy material can be placed to the user's skin, the more protection the user will have both from blows and from hypothermia.

An additional problem experienced with life-jackets is the need to ensure that the life-jacket remains in situ on the person when he or she falls into the water. This is achieved by providing a crotch strap so that the life-jacket will not slide off in the water. Again, buckles and waist straps are also provided to ensure that the life-jacket will not slide off in the water. However, again all these crotch straps, belts, etc. require the user to use them and this has been heretofore experienced as a particular problem. In any case they are uncomfortable to sit on, to move around in or to wear generally. Further, there is a law of the sea which states "Every extra piece of equipment or gear you wear catches and fouls in other gear". Being pulled up stationary as you go to do some task or being caught in equipment is generally dangerous.

For commercial fishing operations in extreme conditions, for example, working in arctic regions, prolonged naval operations in adverse weather conditions where the weather conditions are a secondary consideration, attempts have been made to provide suits often made of a generally waterproof material with a closure system for neck, waist and ankle openings similar to so called yachting wet or dry suits in construction. Where these suits are somewhat different is that they often have an inner shell incorporating some form of heat insulation material which by its very nature offers some flotation support but is mainly for preventing the onset of hypothermia whether immersed in water or not. These suits suffer from all the disadvantages discussed already in that they are bulky, cumbersome, unwieldy and only worn in extreme conditions. In general terms they suffer, if not more acutely, from the problems outlined above. Further, in conjunction with such suits it is necessary to wear additional buoyancy aids whether as a separate life-jacket, with its added problems or some form of in-built buoyancy when the natural buoyancy of the suit, in use, adds to the survival problems. Again, if separate from the suit the life-jacket is often discarded.

Accordingly, it became apparent to the applicants when they examined this problem that if one were to state simply and clearly what was required in respect of a life-jacket, it could be stated as:

- to ensure that a life-jacket would be worn;
- to ensure that it was sufficiently comfortable to be worn without undue restriction of movement; and
- to ensure that it is worn as close to the body as possible to provide the maximum protection.

In stating the above, it is important not to lose sight of the principal purpose of a life-jacket, namely that it must have sufficient buoyancy to support a person in the water in the optimum floating position. That support must, in addition to supporting the wearer in reasonable safety in the water, be such as to assist in the recovery or rescue of the wearer. Indeed the actual distribution of the buoyancy on the wearer's body is of considerable importance in achieving this.

These and other objects are the purpose of the present invention.

STATEMENTS OF INVENTION

Accordingly the invention provides a life-jacket comprising:

- an upper body garment having a front, back, waist, armpits and neck;
- buoyancy material contained in the garment; and
- articulation zones formed in the buoyancy material for hinging and flexing of the buoyancy material, said articulation zones being coincident with the articulation zones of a wearer's upper torso during specified boating activities.

Preferably, the garment comprises:

- a double-skinned garment of two layers of material;
- a plurality of pockets formed in the garment by joining the layers together; and
- separate buoyancy material in each pocket, the spacing between the pockets and the shape and deployment of the buoyancy material being such as to prevent undue contact between adjacent pockets on articulation.

In this embodiment the garment is a vest-like, sleeveless garment having a closable front opening and comprising in the front on each side of the opening:

- a pair of lower pockets spaced apart from each other, adjacent, above and across the waist to define with the waist, a waist articulation zone;
- a pair of intermediate pockets spaced apart from each other and across and apart from the lower pockets and extending towards the armpits to define with the lower pockets an underneath ribs articulation zone;
- a pair of spaced apart chest pockets above and spaced apart from the intermediate pockets to define with the intermediate pockets a mid-ribs to armpits articulation zone;

a shoulder pocket above and spaced apart from the chest pockets to define with the chest pockets a below collar bone to armpits articulation zone and with the neck a top of the shoulder articulation zone; and the spacing between each pair of lower pockets, intermediate pockets and chest pockets together forming an intermediate twist articulation zone.

The garment additionally has a back comprising:

a pair of lower back pockets spaced apart from each other, adjacent above and across the waist portion to define with the waist a back of the waist articulation zone;

a pair of intermediate back pockets spaced apart from each other, adjacent above and apart from the lower back pockets and defining with the lower pockets a mid-back articulation zone;

a pair of upper back pockets spaced apart from each other adjacent above and apart from the intermediate back pockets and defining with the intermediate back pockets a shoulder articulation zone and with the neck of the garment a neck articulation zone; and the spacing between each pair of lower back pockets, intermediate back pockets and upper back pockets defining a spine articulation zone.

Another form of life-jacket is one in which the garment is a vest-like front opening sleeveless garment comprising on the front on each side of the opening:

a lower pocket spaced apart from, adjacent and across the waist to define with the waist, a waist articulation zone;

an intermediate pocket spaced apart from, above and across the lower pocket and extending towards the armpits to define with the lower pocket an underneath ribs articulation zone;

a chest pocket above and spaced apart from the intermediate pocket to define with the intermediate pocket a mid-ribs to armpits articulation zone;

a shoulder pocket above and spaced apart from the chest pocket to define with the chest pocket a below collar bone to armpits articulation zone and with the neck a top of the shoulder articulation zone.

With this form of life-jacket, the garment additionally has a back comprising:

a lower back pocket adjacent above and across the waist to define with the waist a back of the waist articulation zone;

an intermediate back pocket adjacent above and across the lower back pocket to define with the lower back pocket a mid-back articulation zone; and an upper back pocket adjacent above and across the intermediate back pocket to define with the intermediate back pocket a shoulder articulation zone and with the neck of the garment a neck articulation zone.

Ideally, the garment comprises a figure hugging elasticised garment in which the buoyancy material is directly affixed thereto.

In the life-jacket according to the invention, the buoyancy material may comprise a base sheet carrying a plurality of separate protuberances of buoyancy material.

The protuberances are preferably formed of one or more sizes and are of any regular shape such as: cubic; rectangular; ovoid; spherical; semi-spherical; conical; pyramidal; or truncated, spherical, semi-spherical, conical or pyramidal.

A particularly suitable construction of life-jackets described above is to have a lower trouser portion integral therewith.

Ideally, in this case the upper garment portion and the lower trouser portion are releasably attached at a waist portion.

Again with these constructions of life-jacket there is provided wearer protection pads incorporating a foam material and suitable articulation joints formed by stitching parallel to the desired hinge movement.

The invention also provides a life-jacket comprising:

an upper body garment having a front, back, waist, armpits and neck;

buoyancy material contained in the garment; and a lower trousers having a seat portion and a pair of leg parts, the lower trousers having a waist formed by the waist of the upper body garment. Preferably the lower trouser portion is releasably detached from the upper body garment.

Additionally, there is also provided a sailing suit comprising a life-jacket having:

an upper body garment having a front, back, waist, armpits and neck;

buoyancy material contained in the garment;

a lower trousers having a seat portion and a pair of leg parts, the lower trousers having a waist formed by the waist of the upper body garment; and an overjacket having:

a front and a back having additional material to form a shelf to accommodate the upper body garment.

Preferably with this sailing suit the overjacket comprises:

a front closing and opening means;

a collar of elastic water sealing material having releasable connection means to form a tubular neck hugging seal, capable of folding in on itself;

sleeves terminating in wrist portions of elastic water sealing material, the sleeves being cut so as to lie when laid out flat above and beyond on either side of the collar;

a pouch of flexible material having an openable and closable downwardly directed mouth, the pouch being secured along one seam to the back of the overjacket below the collar; and a head protecting hood stored within the pouch and connected thereto.

Additionally, the invention provides a method of making a life-jacket comprising the steps of:

identifying appropriate articulation zones for a specific boating activity for a user;

preparing a pattern to allow the cutting of an upper body garment;

marking the articulation zones on the pattern;

preparing suitable buoyancy material;

cutting out the upper body garment;

partially making up the garment;

adding the buoyancy material, taking due account of the articulation zones; and finishing the garment.

In this method the upper body garment may be formed from an upper body base vest of elasticised material for wear close to the user's skin and in which the buoyancy material is directly affixed thereto.

It is possible with the method according to the present invention to carry out the steps of:

part forming an upper body garment with an open back pockets and two open front pockets;

forming a buoyancy panel for each pocket, each panel having a base sheet with buoyancy material affixed thereto defining appropriate articulation zones for the specific pocket;

inserting the buoyancy panel into each pocket;

securing the buoyancy panels within each pocket; and finishing the life-jacket.

According to the invention there is provided a life-jacket of the type comprising an upper body garment containing a quantity of buoyancy material, characterised in that the buoyancy material is articulated to provide articulation zones for the garment coincident with those naturally occurring in boating activities. It will be appreciated from the discussion above that free body movement of the wearer of a life-jacket is one of the most important features that can be achieved, because once the life-jacket can be worn without constriction of movement, then the life-jacket will be worn. Constriction of movement is the greatest disincentive towards wearing a life-jacket.

Additionally, there is provided a life-jacket wherein the garment has a plurality of pockets each containing a buoyancy material and in which the buoyancy material and pockets are so arranged as to provide the articulation zones therebetween. This construction of life-jacket is essentially the application of the present invention to the commonest technology used in the production of life-jackets other than inflatable ones. The invention leads to a considerably increased mobility being achieved. At the same time the wearer has a construction of life-jacket which he or she is familiar with.

One particularly suitable life-jacket according to the invention is one in which the shape and deployment of the sheets of buoyancy material is such as to prevent undue contact between adjacent pockets on articulation. One of the most advantageous forms of buoyancy material is flotation material of a foamed plastics cellular construction. This material is relatively cheap, easily cut and is used already for life-jackets.

A particularly suitable form of the life-jacket according to the invention is one in which the garment is vest-like and sleeveless having a back portion and a front portion and including a front opening waist, armpits and neck portions and having seven pockets on each side of the front opening comprising a pair of lower pockets adjacent across and above the waist, a pair of intermediate pockets above the lower pockets and extending into the armpit area, a pair of chest pockets above the intermediate pockets and a shoulder pocket, the pockets cooperating in defining a waist articulation zone an underneath ribs articulation zone, a mid-ribs to armpits articulation zone, a below collar bone to armpits articulation zone and a top of the shoulder articulation zone and an intermediate twist articulation zone. This life-jacket provides the optimum number of articulation zones for boating use. It is possible to provide additional articulation zones and in certain instances, this may be desirable, however, this particular choice of articulation zone has been found to be particularly useful. A particular form of this life-jacket is made in which each of the pockets forming a pair of pockets are joined to form the one pocket. This life-jacket provides what is probably a more practical number of articulation zones for boating use in that it can be relatively easily manufactured. With these life-jackets additionally there are three pairs of additional pockets extending across on the back portion defining a waist articulation zone, a mid-back articulation zone, a shoulder articulation zone, a neck articulation zone and a spine articulation zone. This aids the wearer to bend more easily, and preferably there may be two additional pockets extending across on the back portion defining a waist articulation zone, a mid-back articulation zone and an upper back articulation zone. It will be appreciated that while bending of the back is not nearly as important as having freedom of movement in the front chest region for most people engaged in maritime pastimes, it is indeed advantageous to provide at least these articulation zones for a person's back.

In one suitable construction of life-jacket according to the invention the upper body garment has a base sheet of an elastic form hugging material, and in which the flotation material is affixed thereto. This can be particularly advantageous because it is possible now to totally customise a life-jacket for a user. This will be particularly advantageous to those carrying out very active boating activities such as olympic helming, championship canoeing, etc.

Further and ideally with any of these life-jackets they may be provided with a collar containing flotation material. The advantage of a collar containing flotation material is that, as is discussed in the specification, it ensures when a person falls overboard or falls into water, when unconscious, that person will naturally be turned onto his or her back with the face exposed for breathing. This is particularly important also when people have been in the sea for some time and are beginning to weaken.

Ideally, the buoyancy material comprises a base sheet carrying a plurality of separate protuberances of buoyancy material. The advantage of having a base sheet with a plurality of separate protuberances is that added flexibility can be provided either as one whole panel without the need to provide a large number of panels as described above or alternatively it will provide additional flexibility and articulation within panels themselves when a number of panels are chosen. With this latter form of buoyancy material, adjacent protuberances are spaced apart a distance sufficient, on articulation about a mid-way hinge line therebetween, to ensure substantial constricting contact does not occur. The advantage of placing the protuberances this distance apart is that obviously they are less likely to foul with each other and if the distance apart can be kept to approximately double the depth of the adjacent edges, or double the depth of the largest portion or projection of them that are likely to contact, then it is possible to flex and bend the sheet without any constriction. The protuberance may be formed from one or more shapes and sizes. The advantage of having different shapes and sizes of protuberances is that depending on where the buoyancy material is placed, greater or lesser numbers and amount of flotation material may be used. This would be particularly advantageous in areas adjacent those articulation zones that must be kept as free as possible and also will allow the choice of material to provide articulation at other zones which are not necessarily free of buoyancy material. The protuberance may be of any regular shape such as: cubic; rectangular; ovoid; spherical; semi-spherical; conical; pyramidal; or truncated, spherical, semi-spherical, conical or pyramidal. In many instances, the particular shape of the protuberance will be very important as it will allow the protuberances to, on contact, slide off each other or otherwise avoid interlocking.

Ideally the buoyancy material includes inflatable buoyancy units. It is envisaged that with the present invention, inflatable buoyancy units could be particularly advantageous to provide in certain instances more buoyancy than is necessarily required. This would be particularly the case where the life-jacket inherently has relatively little buoyancy material, at least in respect of providing full life-saving buoyancy for a considerable period of immersion in water. Further these may be automatically inflatable on contact with water. Automatically inflatable buoyancy is well known and would be particularly advantageous for example in the construction of an auxiliary collar for use with a life-jacket according to the present invention.

In a particularly preferred embodiment of the invention, the life-jacket has a lower trouser portion integral therewith. The use of an integral lower trouser portion forming part of the life-jacket is that the life-jacket can now be worn as close to the skin as possible thus, the articulation zones will be almost directly on the user's body, thus, further facilitating freedom of movement and obtaining maximum advantage from correctly chosen articulation zones. The trouser portion will also ensure that even if the upper body garment portion is opened as is often the case when people are wearing life-jackets that the trouser portion will ensure that on immersion in water the life-jacket will not float away from the user, nor indeed will it ride up the body. A trouser portion is obviously the ideal construction to ensure that a life-jacket will be retained in position. It is preferable to having straps or other crotch supports. This then in effect allows one to provide what is known as a "long-john" which will generally be worn all the time and thus ensures that the user always is wearing his or her life-jacket. Ideally, the upper garment portion and the lower trouser portion are releasably attached at a waist portion. While apparently the use of a zip will obviate some of the advantages of the use of a trouser-like construction, there are major advantages in having this construction as it will allow either the upper garment portion containing the buoyancy material and thus liable to deterioration or the lower trouser portion more liable to tearing or other damage to be independently replaced. Also in certain situations, it will be possible to replace the trouser portion which would generally have long legs with a trouser portion with short legs. Finally, because the upper body garment can now be placed very close the user's skin it will be possible to ensure that the correct upper body garment is chosen to snugly and comfortably fit the user. This means that a wider range of sizes of upper body garment may be provided thus providing a much more efficient life-jacket.

With this particular form of life-jacket incorporating at lower trouser portion, there is provided wearer protection pads incorporating a foam material and suitable articulation joints formed by stitching parallel to the desired hinge movement. Thick material is often used to provide wearer protection pads, however they are cumbersome and tend to make any garment to which they are attached and in particular trousers and jackets less flexible and more unwieldy. However, the provision of the articulation joints greatly improves mobility. Ideally this wearer protective pad is a knee pad. One of the major places where mobility is required is for knee joints and the present invention provides this. Additionally, there is provided a seat pad. There is nothing worse than having a relatively rigid seat pad as it causes considerable discomfort when sitting or working in a maritime environment and the present invention by providing an articulated joint in the seat pad greatly improves mobility and comfort.

In a still further embodiment of the invention there is provided a life-jacket of the type comprising a body garment containing a quantity of buoyancy material characterised in that the body garment comprises an upper body garment containing the buoyancy material and a lower trouser portion integral therewith. Even with a life-jacket having an upper body garment of substantially the same construction as conventional life-jackets, with buoyancy placed without any real consideration of articulation zones, considerable advantages may be achieved by simply mounting that upper body garment containing a quantity of buoyancy material in combination with a lower trouser portion. Many of the advantages of the present invention without the added mobility that is provided with it are achieved and in particular the feature of encouraging people to wear the life-jacket and also the feature as explained above of retaining the life-jacket in situ even when partially opened are achieved. It is obviously not as advantageous as with the upper body garment containing a quantity of buoyancy material which is articulated to provide articulation zones coincident with those naturally occurring in boating activities, however there are considerable advantages. Ideally in this latter embodiment the lower trouser portion is releasably detached from the upper body portion. The advantages of having the upper body garment portion separable from the lower trouser portion have already been explained and does not need reiteration.

It will be appreciated that the life-jacket according to the present invention is particularly suitable for forming a sailing suit and accordingly, the present invention provides a sailing suit in combination with a life-jacket as described above in which there is provided additional material adjacent and across a back of an overjacket waist portion forming a shelf to accommodate the upper garment portion of the life-jacket. One of the major reasons why conventional life-jackets are worn over jackets is that they do not fit comfortably beneath them. The present invention overcomes this problem by providing a shelf at the back of the jacket, which shelf accommodates easily an upper body garment forming part of a life-jacket, or an upper body garment forming the whole life-jacket. In such a sailing suit the jacket in one embodiment is a front opening jacket and has elastic water sealing material on both wrist portions, together with an enlarged collar of elastic water sealing material which can be folded on itself and joined end to end to form a water-tight seal.

The advantage of the enlarged collar of elastic water sealing material is that it obviates the need for the user to wrap his or her neck in towels or other materials to prevent the ingress of moisture, but a relatively simple sealing can be provided when required. In an embodiment of the invention a sailing suit in which the jacket has arm portion so cut as to naturally lie at above a right angle to the main body of the jacket. This particular construction of jacket arm advantageously ensures that there is no constriction whatsoever on a user's arm when carrying out most boating operations and indeed it makes it much easier to stretch upwards and does not cause the arm of the garment to slip down the user's forearm. This may seem relatively unimportant, however, when wrist seals and the like are used as is becoming more prevalent in such jackets, the wrist seal tends to secure the wrist of the jacket firmly onto the user's wrist and then considerable difficulty, particularly in raising a person's arm over the head is often encountered, the jacket forming a major constriction. In any sailing suit according to the invention, there is provided a hood connected by a seam across the back of the jacket and storable within a flexible pouch having a downwardly directed mouth. Because a particular form of collar is used, it is not possible to place with any degree of comfort such a pouch for storing a hood on the exterior of the collar as has heretofore been the practice. It has been found that it is not simply a question of replicating what has been done heretofore, but that there was a need to provide a new type of pouch or at least a pouch slightly differently sited than heretofore, together with a differently shaped hood.

The present invention provides a method of making a life-jacket comprising the steps of:

identifying articulation zones for a specific boating activity for a user;

marking out those articulation zones; and making up a life-jacket with buoyancy material most or all of which does not cover these articulation zones.

It will be appreciated that making a life-jacket in this manner will ensure that the optimum freedom of movement is achieved. In this method it is ideal to perform the additional steps of preparing specific patterns of articulation zones for specific sizes of user. This will be particularly advantageous in that heretofore life-jackets have been produced in a very small range of sizes and it will now be possible according to the present invention to produce them in a greater range with added advantages.

In one method according to the invention, there is performed the step of preparing a specific pattern for an individual is carried out. Obviously customising a life-jacket for a user will be particularly advantageous for the particular user and while it may cost more than a more conventional life-jacket, it will have considerable advantages in use.

In one method according to the invention there is performed the steps of:

making a suitable upper body base garment for wearing relatively close to the skin of a user;

marking the necessary articulation zones on the garment; and fixing buoyancy material to the base garment outside the articulation zones.

The closer the garment is to the skin, the more likely the articulation zones will be correctly accommodated. In this latter method, ideally the additional step of covering the base garment and buoyancy material with an outer cover material. This provides a particularly suitable way of making the garment.

In one method according to the invention there is manufactured a life-jacket by performing the steps of part forming an upper front opening garment with three pockets namely two front and one back pocket;

forming a buoyancy panel for each pocket having a base sheet carrying a plurality of separate protuberances of buoyancy material;

inserting the buoyancy material in each panel; and finishing the formation of the life-jacket.

It will be appreciated that this is particularly advantageous in that conventional life-jacket forming is now further simplified in that it is not necessary to stitch a large number of panels, but that the buoyancy material may be preformed to the correct shape and then simply placed in position.

DETAILED DESCRIPTION OF THE INVENTION

The invention will be more clearly understood from the following description of some embodiments thereof given by way of example only with reference to the accompanying drawings in which.

Figure 1:
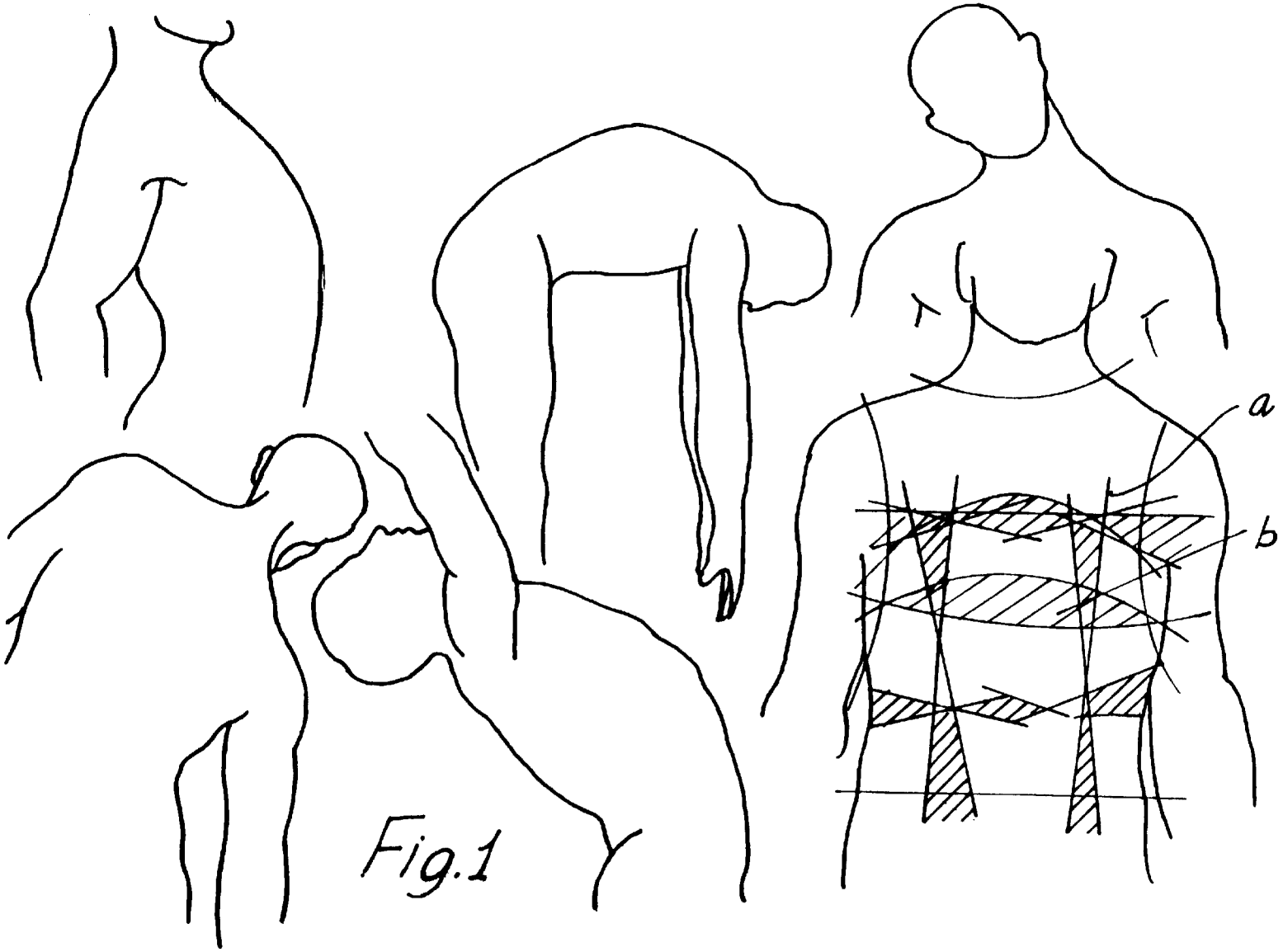
FIG. 1 is a view of a person carrying out certain physical body movements.

Before discussing the invention it is necessary to discuss in some detail the manner in which this invention was approached.

Firstly, the term "articulation zone" as used in this specification is a general term to define that portion of a human body which is between two parts of a body when relative movement occurs such as bending, twisting, pulling, stretching, etc. Thus, it is in effect that portion of the body which accommodates and acts as the connection between the two relatively moving parts of the body. It is therefore essential if the ease of relative movement is to occur that there is no constriction on such articulation zones in the body. There are obviously a large number of articulation zones in everybody and in particular in the upper torso. It is important to appreciate that depending on the activity the articulation zones change in frequency of use and hence importance. For boating there are subtly different degrees of usage and importance of the various articulation zones. In general, in the upper chest they are the guno humeral joint—the upper arm socket, the lower cervical joint—the neck area, the acromonio clavicular joint—the portion between the arm socket and the neck, the lower truncal flexion and extension—the transverse zone across the waist, the subcostal region—the transverse zone mid-way up the ribs which is slightly arcuate sloping upwards to the solar plexus and then the abduction of the shoulder joint—the portion of the body moving in on itself from mid-socket above the solar plexus. These can generally be described as the most important boating articulation zones for the front chest area of the upper torso. Similar articulation zones occur in the lumbar/back region, the most important being the lumbar sacral junction—the natural hinge of the lower spine. There are then different degrees of importance of the articulation zones depending on the specific boating activity, not just simply between for example cruising and canoeing or is fishing and dinghy racing, but also between the activity of a keel boat helm and a crew member such as a foredeck hand. The helm needs an ability to twist the upper torso and to hold a tiller comfortably while the foredeck hand needs to be able to pull ropes and move about the boat freely. Women by their very nature have in turn somewhat different requirements, particularly in relation to upper body movements.

The first approach before proposing a solution to the problems described above was to identify and examine these articulation zones and not just simply to make haphazard guesses as has heretofore apparently been the situation. This is not to indicate that such investigation and analysis has not been carried out but simply to suggest that it has not been applied practically to life-jackets. Some relatively simple and superficially obvious experiments were carried out in which various sailors' bodies were encased in a material and they were then asked to carry out normal sailing exercises, which sailing exercises caused marks, creases or other indicia to be formed on the material showing where creases and bends had occurred and their frequency. It was then decided that the first thing one must do is to remove any restriction of movement from those articulation zones and this was the first basis of the invention. The logical answer must be to remove as much material and thus buoyancy from these zones.

Referring now to FIG. 1 there is illustrated these body movements and the fold or hinge lines are shown. The logic of this is that the areas between those hinge lines as illustrated in the drawing and identified by the reference letter a form between them articulation zones b, shown by cross-hatching.

In a design it would appear obvious that any buoyancy material should be placed in a life-jacket not to impede the articulation zones as laid out in FIG. 1.

There are similar articulation zones in the back, however, by virtue of the fact that most of the fouling occurs in the front of the body, it has been found that in practice, the articulation zones in the back are not as important. However, it has been discovered that ideally there are probably three transverse and one central articulation zone in the back that requires some consideration and as far as possible should be kept free of impediment.

Then it was necessary to consider how can you ensure that even if a life-jacket manufactured in accordance with the invention is suitable for use that it will be used and it was found as was mentioned already above that no matter how good a life-jacket manufactured in accordance with the invention was that when placed over a user's clothing the sailor would generally discard that life-jacket and what was often the jacket underneath, when some task requiring considerable activity and freedom of movement was required. Thus, while the life-jacket might have the correct articulation, when removed so far from the user's body by being mounted on top of trousers, shirts, pullovers and jackets that they were essentially still very unwieldy and caused considerable difficulty for the user. Further, it is still relatively easy to discard such a life-jacket, particularly when it is worn over a sailing jacket. Further, when it is desired to remove the sailing jacket for comfort, the life-jacket is also removed. This then led to the need to ensure that the jacket was worn as close the skin as possible, when in addition there would be then performed the further useful exercise of providing a close protection for the sailor's torso.

The above analysis is given because it demonstrates the logical approach to this invention which logical approach is surprising as it has not been made heretofore or if it has the consequences for the design and construction of life-jackets have not been appreciated. It is further surprising when one considers the amount of attention that has been paid to the problems and the number of claims that have been made to the solution of these problems that nobody heretofore has arrived at the relatively simple solution proposed in this specification. It is also possible to see that there will be many other ways, other than those described now with reference to the drawings, for carrying out the present invention.

Finally before discussing with reference to the drawings the various life-jackets in accordance with the invention, it is important to appreciate that always there has to be a compromise between producing what would apparently be the most efficient life-jacket and that which is practical. This is common to many industries and to many products. One of the problems that has to be appreciated in respect of most of the foamed cellular material such as closed cell flexible vinyl foam material sold under the Trade Mark VITACEL is that whether provided in block form or as moulded shapes to individual requirements, there is a closing of the outer surface and therefore a loss of buoyancy per unit volume. Further, all close cell foams are subject to volume shrinkage which is affected both by time and temperature. Accordingly, the more a piece of foam such as rectangular sheet of foam is cut up, the more volume is required to provide the same buoyancy. There is thus therefore always a trade-off between the optimum design and the need not to have too many individual pieces of foam, because then the bulkier the garment gets.

This may not necessarily be as big a problem when the buoyancy material is formed in composite sheets as envisaged by the present invention.

Figure 3:
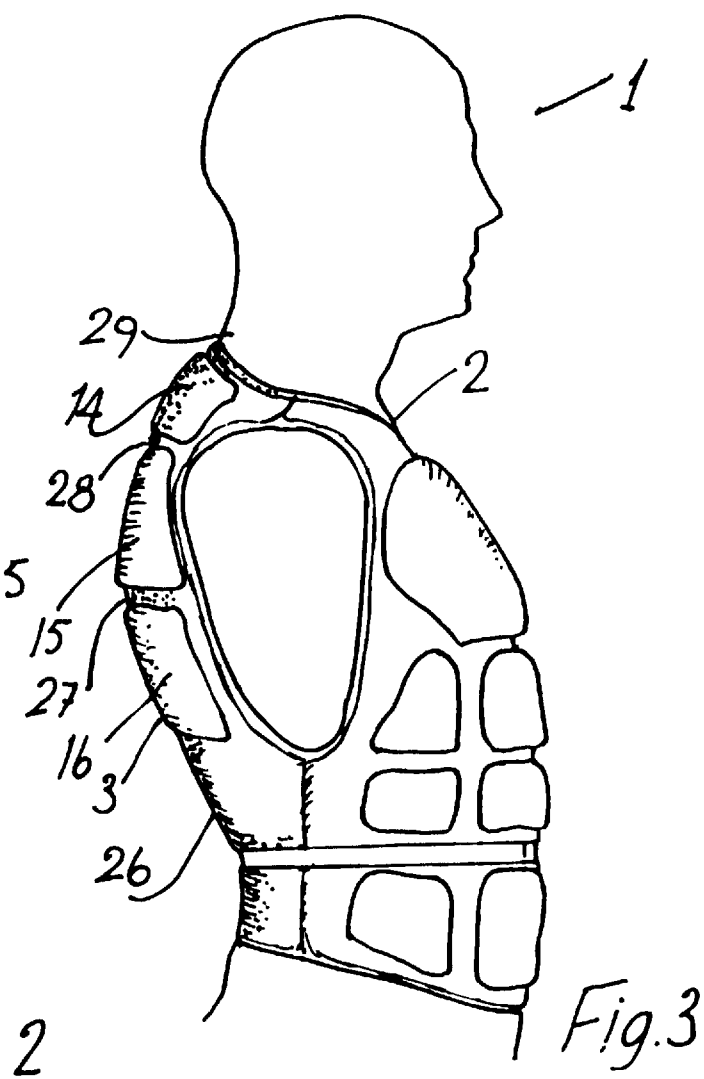
FIG. 3 is a side view of the life-jacket of FIG. 2.
Figure 2:
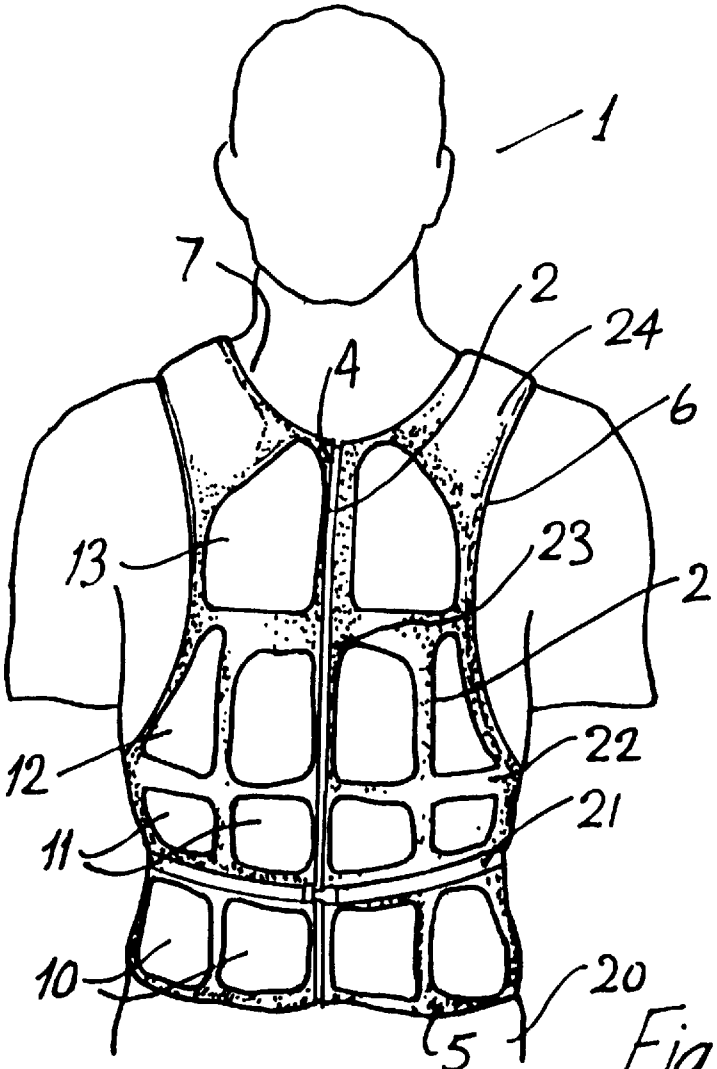
FIG. 2 is a front view of a life-jacket constructed in accordance with the invention.

Referring now to FIGS. 2 and 3 there is illustrated a life-jacket indicated generally by the reference numeral 1, the life-jacket 1 comprises a vest-like sleeveless upper body garment having a front portion 2 and a back portion 3. The front portion 2 has a front opening 4, closed by a conventional zip terminating in a waist 5. It also has armpits 6 and a neck portion 7. There is provided seven pockets on each side of the front opening 4, namely a pair of lower pockets 10 adjacent across and above the waist 5, a pair of intermediate pockets 11 adjacent across and above the lower pockets 10 and extending into the armpits 6 and a pair of chest pockets 12 above the intermediate pockets 11 and a shoulder pocket 13. The pockets define a waist articulation zone 20, an underneath ribs articulation zone 21, a mid-ribs to armpit articulation zone 22, a below collar bone to armpit articulation zone 23 and a top of the shoulder articulation zone 24, together with an intermediate twist articulation zone 25 between the articulation zones 23 and 20.

Referring particularly to FIG. 3 the life-jacket 1 has six back pockets namely a pair of upper back pockets 14, mid-back pockets 15 and lower back pockets 16 defining a back-waist articulation zone 26 which is effectively an extension of the waist articulation zone 20, a mid-back articulation zone 27, a shoulder articulation zone 28 and a neck articulation zone 29. Each pair of back pockets 14, 15 and 16 define a spine-articulation zone, not illustrated.

Buoyancy material of conventional form cut from a rectangular sheet of suitable buoyancy or flotation material or specially formed buoyancy material in accordance with this invention is placed in each pocket.

Figure 5:
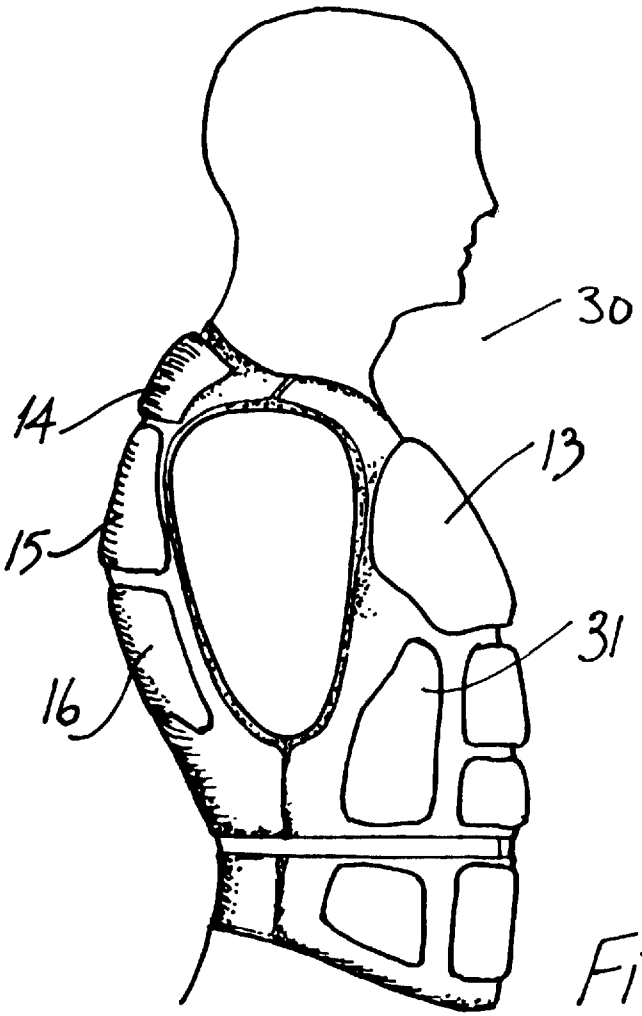
FIG. 5 is a side view of the life-jacket of FIG. 4.
Figure 4:
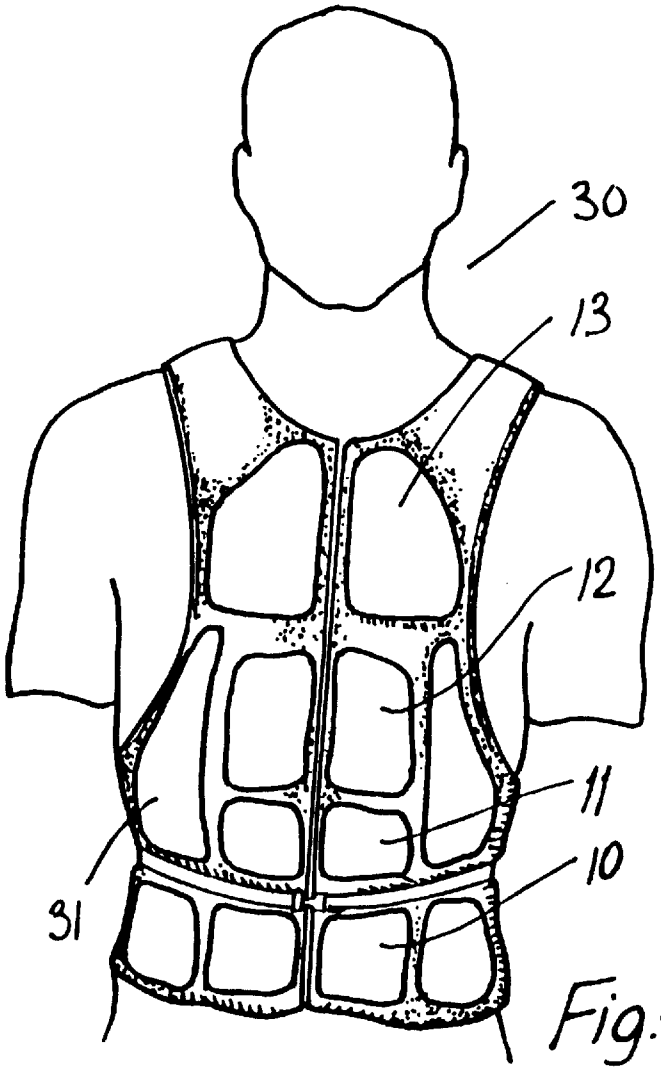
FIG. 4 is a front view of another life-jacket.

Referring to FIGS. 4 and 5 there is illustrated an alternative construction of life-jacket, indicated generally by the reference numeral 30 in which parts similar to that described with reference to FIGS. 2 and 3 are identified by the same reference numerals. In this life-jacket two of the pockets 11 and 12 are joined together to form the one pocket 31.

Figure 6:
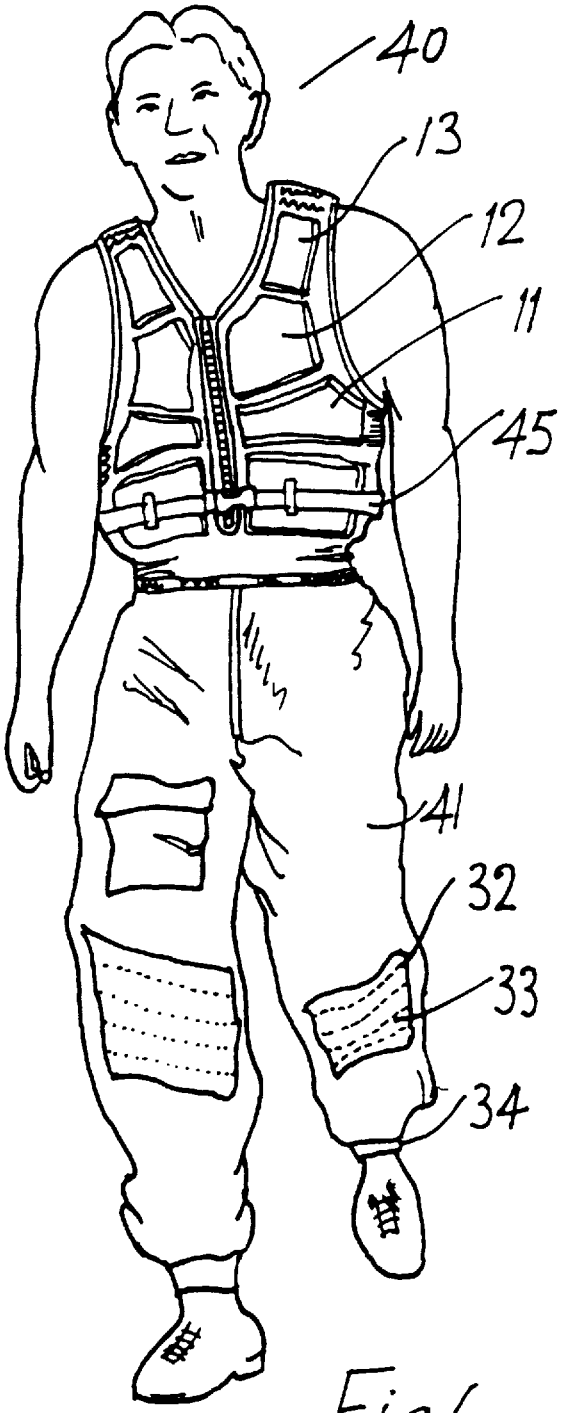
FIG. 6 is a front perspective view of a life-jacket according to the invention, shown in use.
Figure 7:
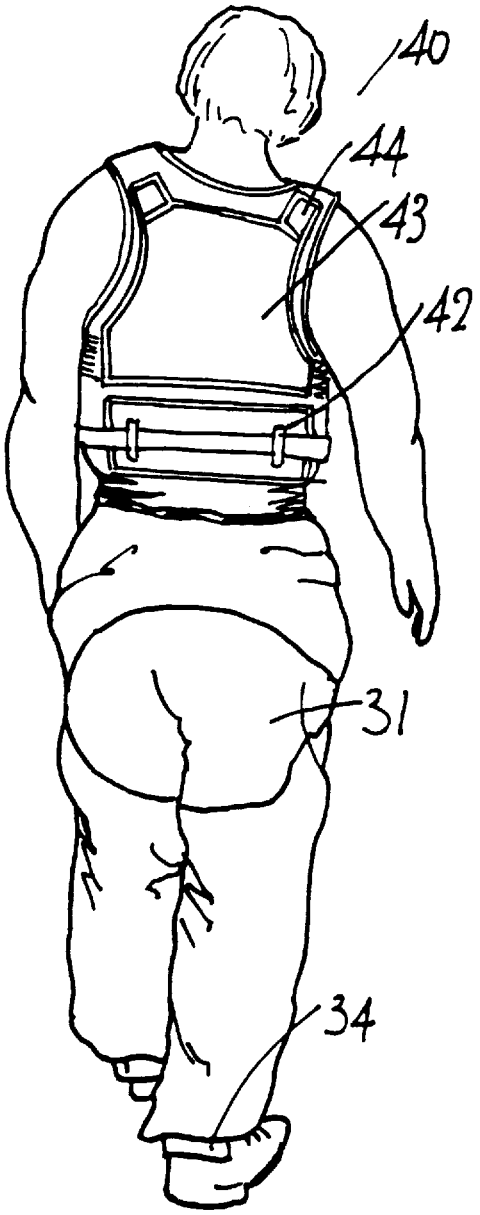
FIG. 7 is a rear perspective view of the life-jacket.

Referring now to FIGS. 6 and 7 there is illustrated an alternative construction of life-jacket, indicated generally by the reference numeral 40 in which parts similar to those described with reference to the previous drawings are identified by the same reference numerals. In this embodiment the life-jacket 40 incorporates a sailing trousers 41. In this embodiment there is provided a lower back pocket 42 a mid-back pocket 43 and shoulder pockets 44. A conventional belt 30 is provided as are rear seat reinforcing portion 31 and knee pads 32. Each knee pad 32 is of close cell foam and has a series of hinges 33 illustrated by the interrupted lines formed thereon by stitching through closed cell foam forming the knee pads 32. Conventional ankle cuffs 34 of neoprene are provided.

Figure 8:
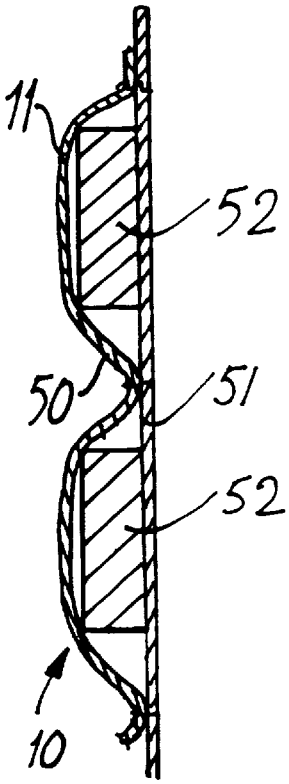
FIG. 8 is a typical cross-sectional view through portion of a life-jacket according to the invention.
Figure 9:
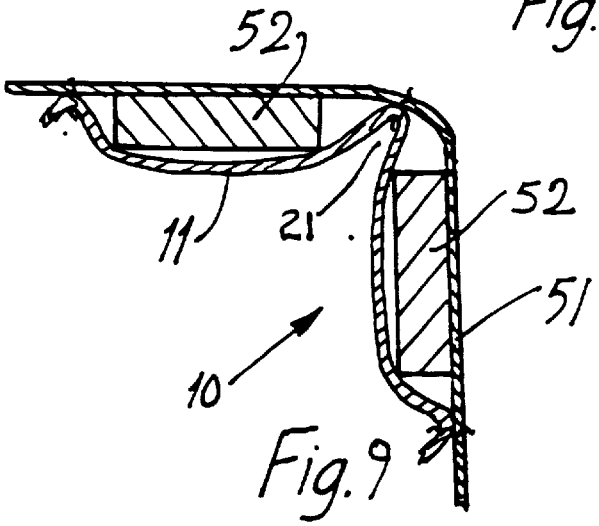
FIG. 9 is a view similar to FIG. 8 showing the life-jacket articulated.

Referring now to FIGS. 8 and 9 where there is illustrated a lower pocket 10 and an intermediate pocket 11 and it will be seen that they are formed simply by the stitching together of an upper sheet of cloth 50 on a lower base sheet 51 into which is placed a rectangular shaped slab 52 of buoyancy material. As can be seen from FIG. 9 when the wearer bends about the underneath ribs articulation zone 21, articulation takes place without any difficulty. The slabs 52 nest together with no difficulty. This essentially, it will be appreciated, is the conventional way of forming portion of such a life-jacket, except for the manner in which the articulation zones are defined and positioned.

Referring now to FIGS. 10 to 13 there is illustrated a sailing suit indicated generally by the reference numeral 60 incorporating the composite life-jacket and trousers illustrated in FIGS. 6 and 7 and parts similar to those described with reference to the previous drawings are identified by the same reference numerals. In this embodiment, there is provided an overjacket 61 being a front opening overjacket, having a zip 62 and wrist seals 63 of an elastic water-sealing material such as neoprene. The suit is provided with a collar 64 shown in more detail in FIGS. 14 and 15.

Figure 14:
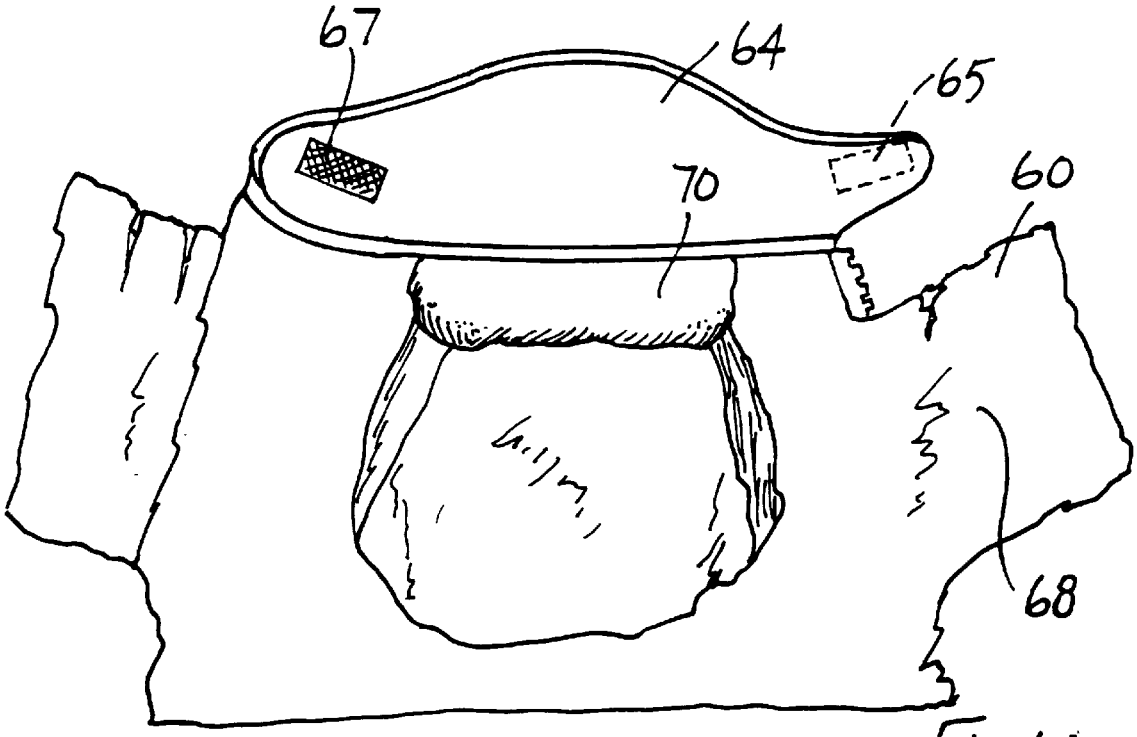
FIG. 14 is a plan view of a collar of the sailing suit of FIGS. 10 to 13 from the inside.
Figure 15:
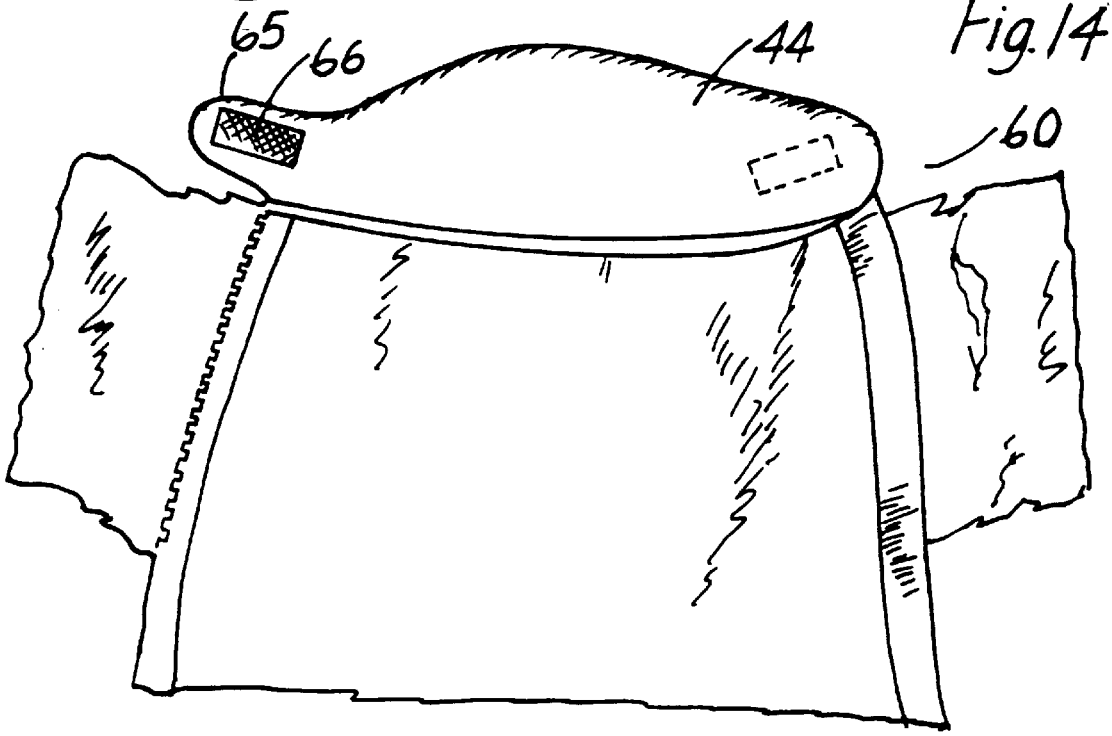
FIG. 15 is a plan view of the outside of the collar of FIG. 14 and part of the exterior of the sailing suit.

Referring specifically to FIGS. 14 and 15, the collar 64 has an elongated connector tab 65 carrying a VELCRO strip 66, a further VELCRO strip 67 is placed on the exterior of the collar 64.

Figure 10:
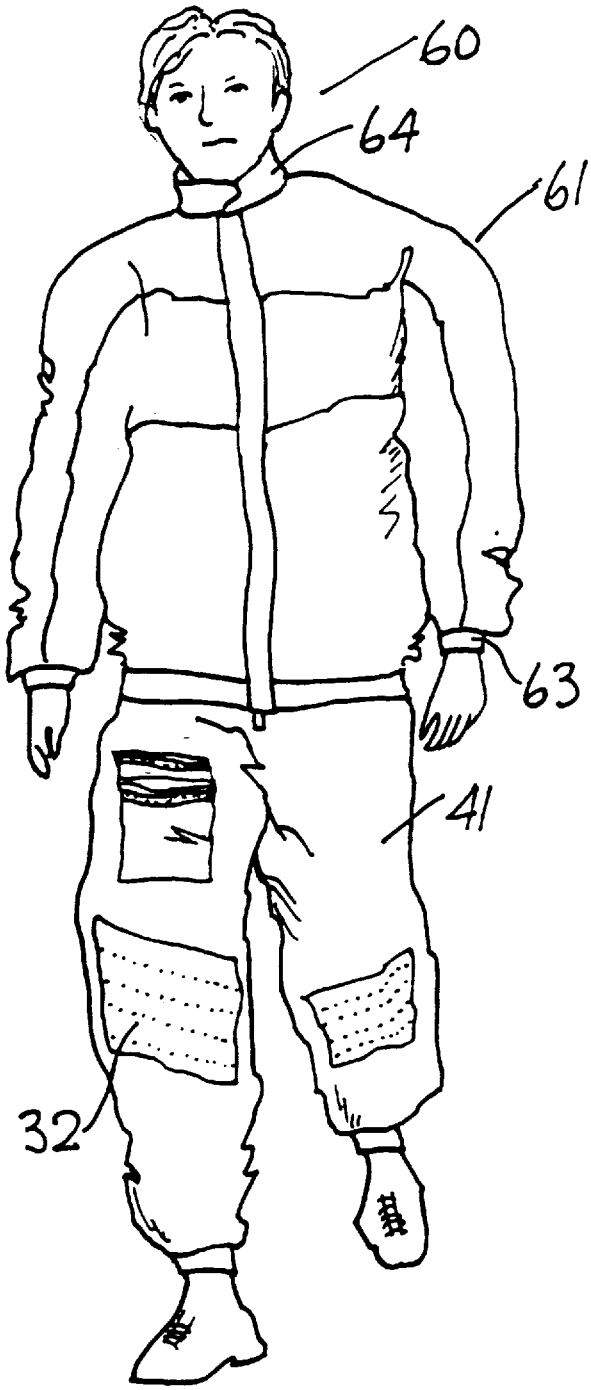
FIG. 10 is a front perspective view of a full sailing suit according to the invention.
Figure 11:
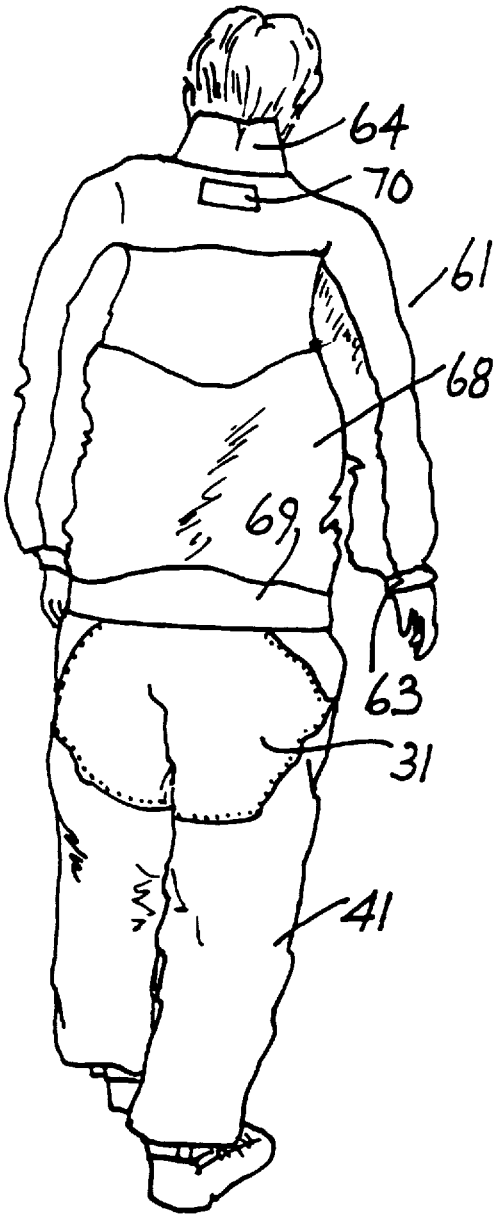
FIG. 11 is a rear perspective view of the sailing suit of FIG. 10.
Figure 12:
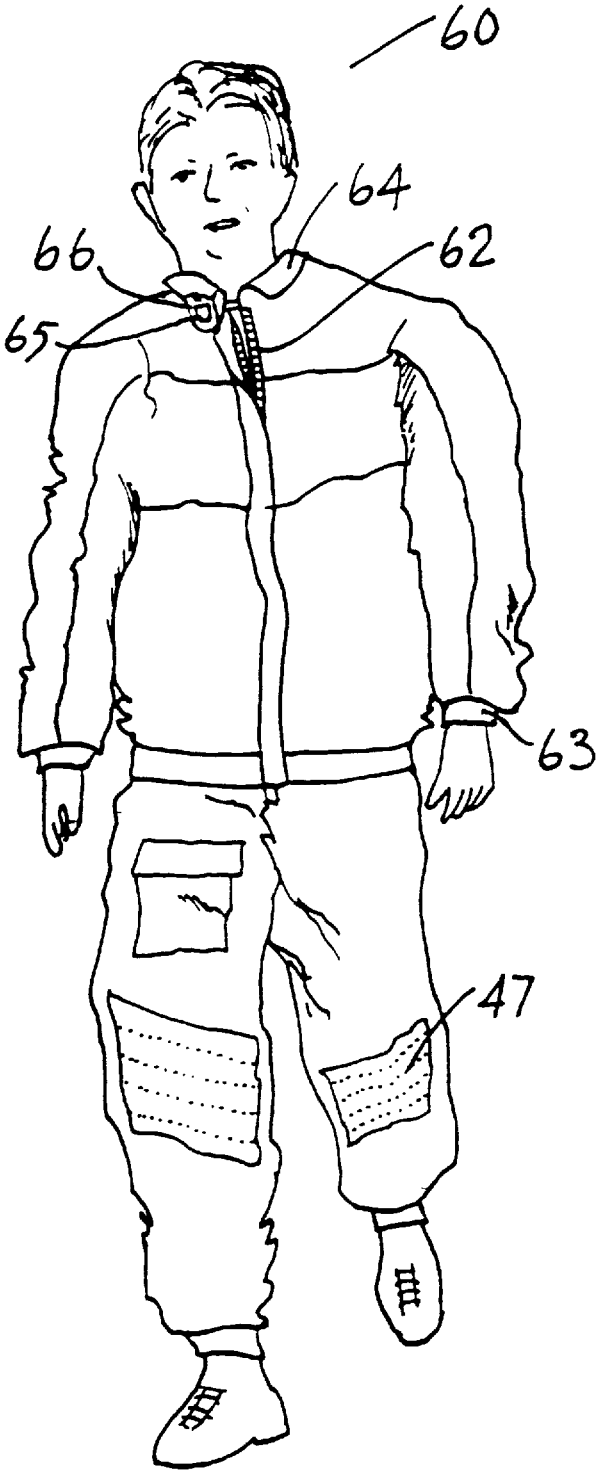
FIG. 12 is a view similar to FIG. 10 showing other details of the suit.
Figure 13:
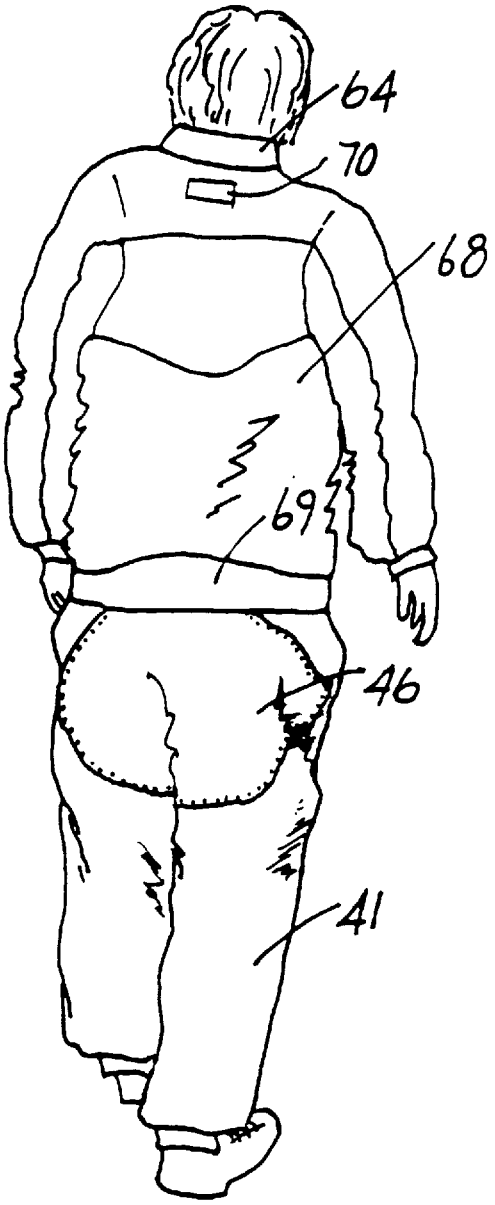
FIG. 13 is a view similar to FIG. 11 showing the suit in a slightly different use.

FIGS. 12 and 13 illustrate the collar used in conventional manner as an ordinary collar, with portion of the collar 64 folded over itself. In FIGS. 10 and 11 it is shown with the two VELCRO strips 66 and 67 attached and the collar 64 folded back over itself inside the neck of the wearer to provide adequate sealing.

On the back 68 of the jacket 61 there is provided additional material adjacent a waist 69 of the jacket 61 to provide what is in effect a shelf to accommodate the bulk of the life-jacket 1 as is described below with reference to FIGS. 16 and 17.

Referring again to FIG. 15 on the back 68 of the jacket 60 there is provided a pouch 70 having a downwardly directed mouth incorporating elasticated material around its periphery and a VELCRO fastener which all being of conventional construction are not illustrated or described in more detail. A hood 71 of superficially conventional construction is provided and mounted across the back 68 of the suit 60.

Many jackets have hoods attached to the collar or in a pouch attached to or forming part of the collar. The problem was with the particular construction of collar in that, if the pouch were to be made part of the collar this would compromise the stretching and sealing capabilities of the collar, while if the hood was mounted into the back of the jacket, this would jeopardise the water-proofness in an immersion situation. Accordingly, the pouch according to the invention is free floating and independent, attached only at the base, having in effect a separate closure solving a particularly tricky problem in a unique way.

Figure 17:
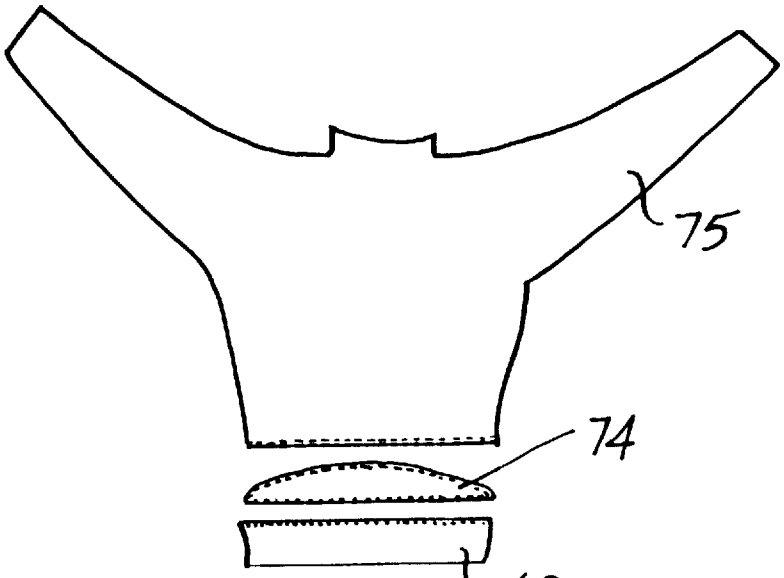
FIG. 17 is part of pattern for constructing the overjacket of FIG. 16.
Figure 16:
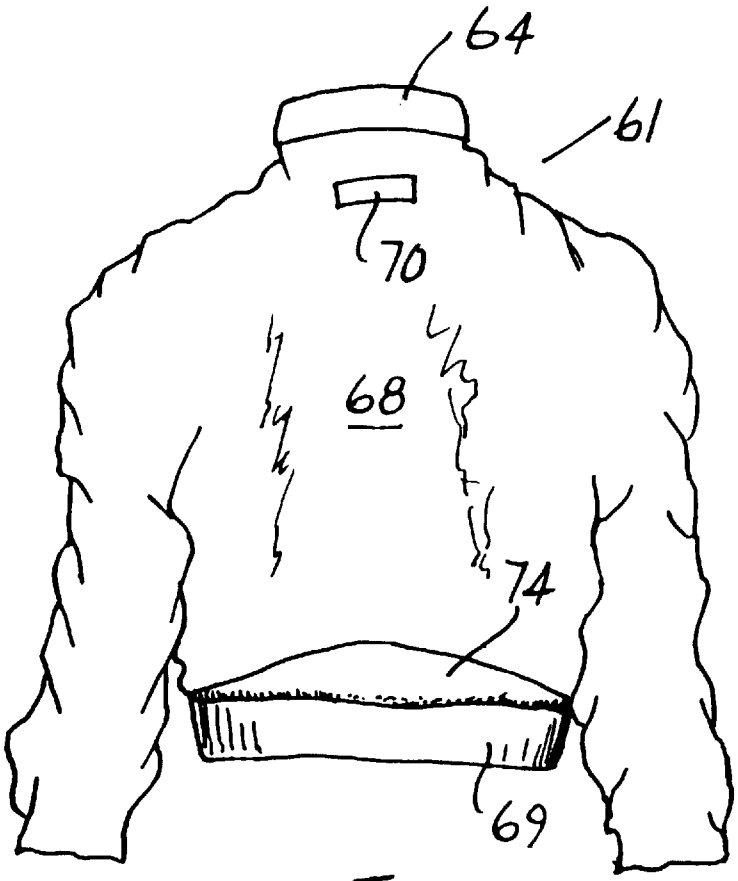
FIG. 16 is another rear view of an overjacket forming part of the sailing suit of FIGS. 10 to 14.

Referring to FIGS. 16 and 17 there is shown in more detail on the back 68 of the overjacket 61 illustrated in FIGS. 10 to 13 the shelf 74 and in particular in FIG. 17 how the shelf 74 is cut out and how the overjacket 61 has sleeves 75 which, because of the way the pattern is cut as can be seen from FIG. 17, will project naturally at above right angles from the main torso covering portion. This while not necessarily aesthetically pleasing with the wearer's arm in repose adds considerable to one's freedom of movement.

It will be appreciated that the closer the life-jacket is worn to the user's skin, the more likely the articulation zones of the life-jacket will coincide with the user's actual corresponding natural articulation zone.

Figure 18:
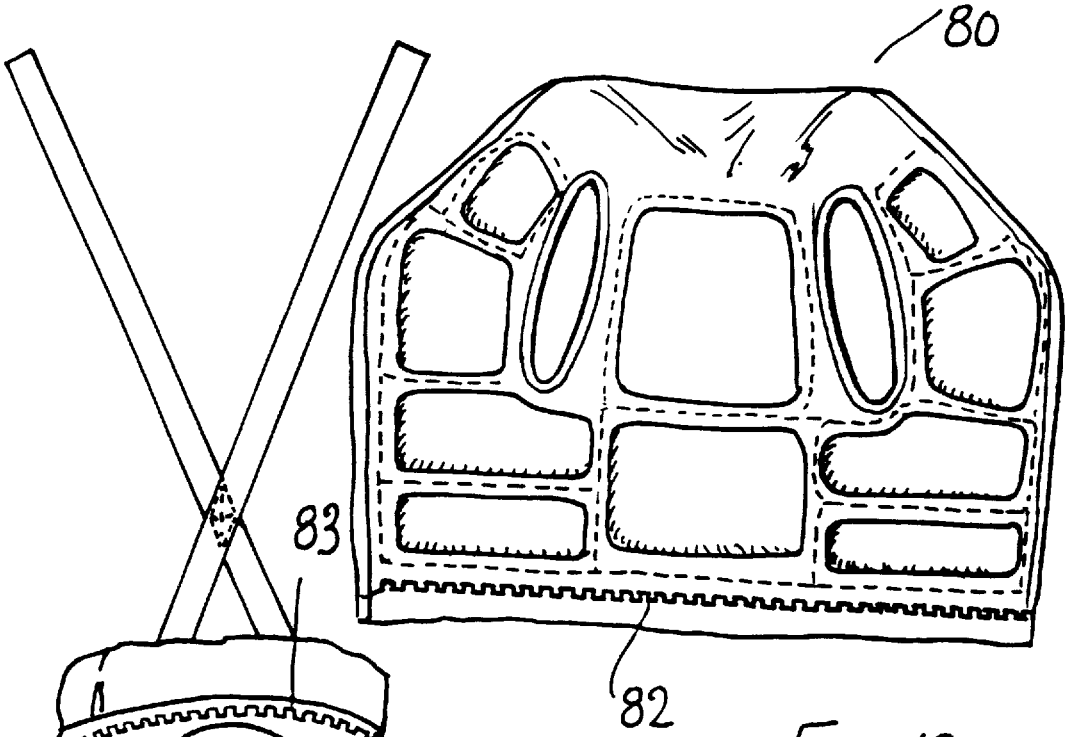
FIG. 18 is a plan inside view of a life-jacket according to the invention.
Figure 19:
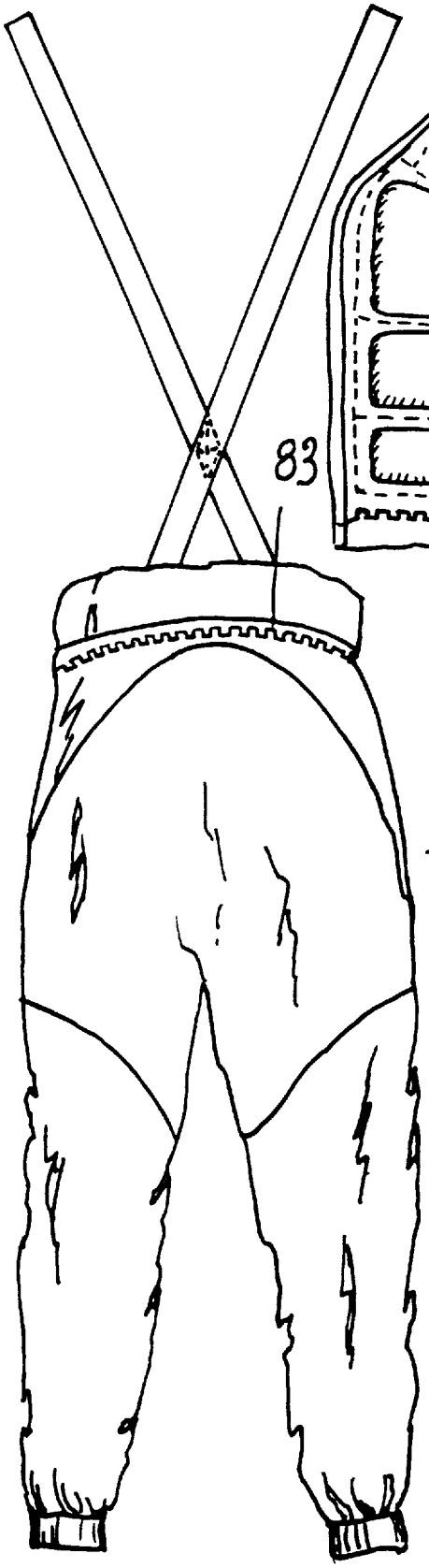
FIG. 19 is a plan rear view of a trousers for use with the life-jacket according to FIG. 18.

Referring now to FIGS. 18 and 19, there is illustrated an alternative construction of life-jacket according to the present invention there being illustrated in FIG. 18 an upper body garment portion indicated generally by the reference numeral 80 and illustrated in FIG. 19 an associated lower trouser portion 81. In this embodiment the upper body portion 80, which is of substantially the same construction as the corresponding portion of the life-jacket 40 of FIGS. 6 and 7 is provided with a portion 82 of a zip. The trouser portion 81 is of conventional construction and is also provided with a portion 83 of a zip so that the upper body portion 80 can be attached and disengaged when necessary from the trouser portion 81 by interengagement or release of the zip portions 82 and 83. This facilitates for example the use of a shorts instead of full oilskin trousers, which shorts ideally would generally incorporate a zip to allow the life-jacket to be attached thereto, or, alternatively, it need not be.

Figure 20:
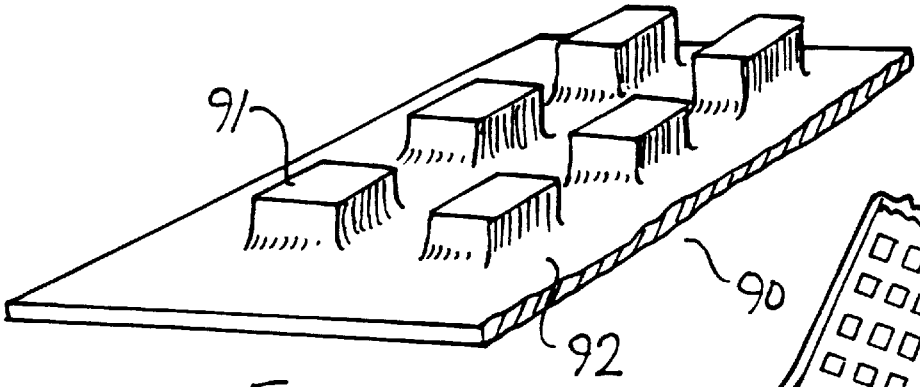
FIG. 20 is a perspective view of buoyancy material used in accordance with the invention.
Figure 21:
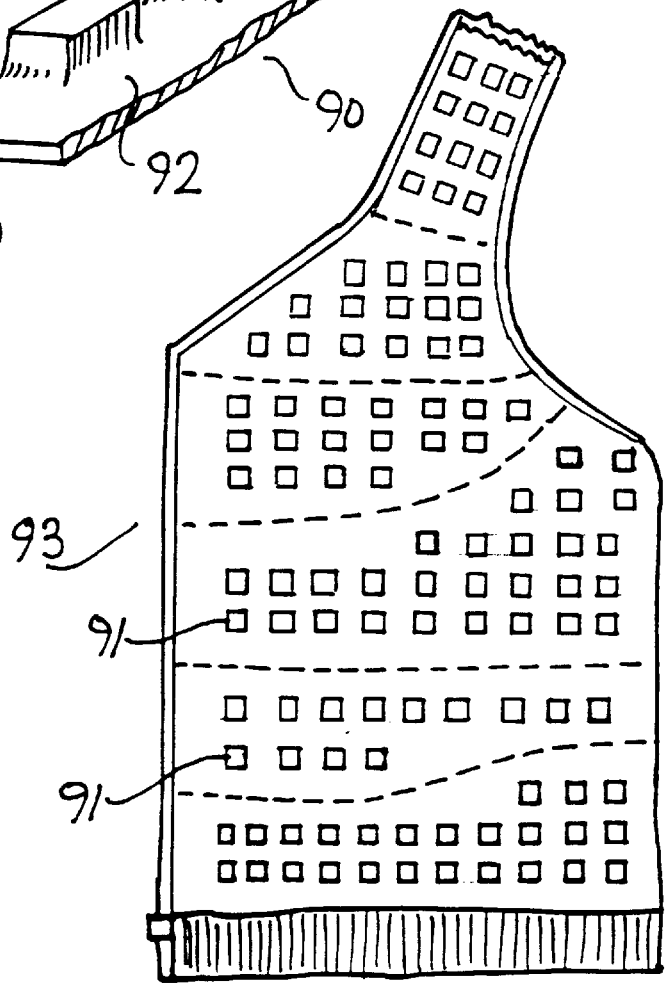
FIG. 21 is a plan view of a composite buoyancy material used with the invention.

Referring now to FIG. 20 there is illustrated a particularly advantageous form of buoyancy material according to the invention, indicated generally by the reference numeral 90. This buoyancy material 90 comprises a plurality of separate protuberances 91 of substantially rectangular shape, mounted on a base sheet 92. This buoyancy material may be placed in pockets such as formed in the life-jackets illustrated in the previous embodiments, or, alternatively, they may simply be placed in one pocket without any further seaming and arranged such as is illustrated in FIG. 14 where a composite sheet 93 is illustrated providing somewhat different articulation zones.

Figure 22:
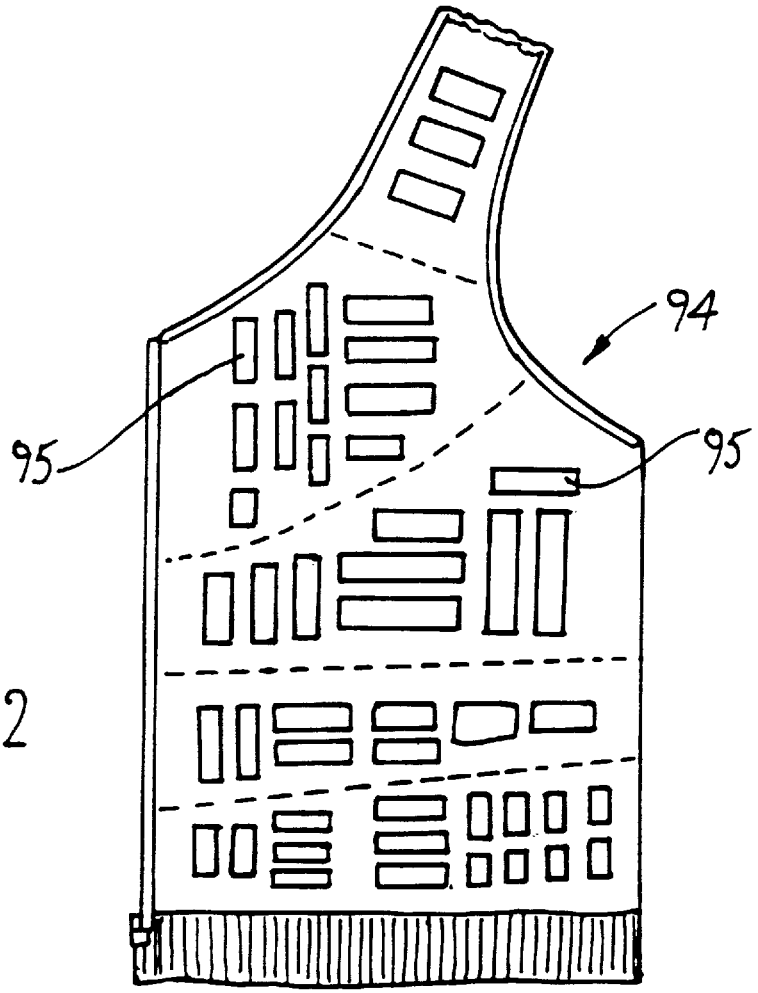
FIG. 22 is a plan view of another construction of buoyancy material.

Referring to FIG. 22 there is illustrated a still further arrangement of buoyancy material 94 formed as one composite sheet for mounting within a life-jacket and having protuberances 95 which are substantially similar to the protuberances of FIG. 13 but now have different orientations and sizes to further facilitate flexing, bending and articulation. With such a sheet, separate pockets may also be formed if desired. The articulation zones are somewhat different than in the previous embodiments.

Figure 23:
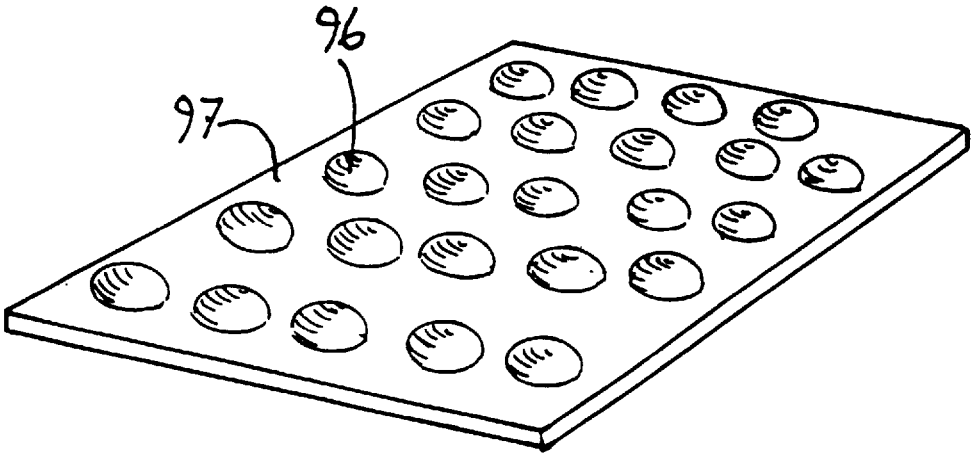
FIG. 23 is a perspective view of a still further construction of buoyancy material.

FIG. 23 illustrates a still further construction of buoyancy material 95 having a plurality of semi-spherical protuberances 96 on a base sheet 97. Again this buoyancy material is used in the same manner as the buoyancy material previously described.

Figures 24, 25, 26:
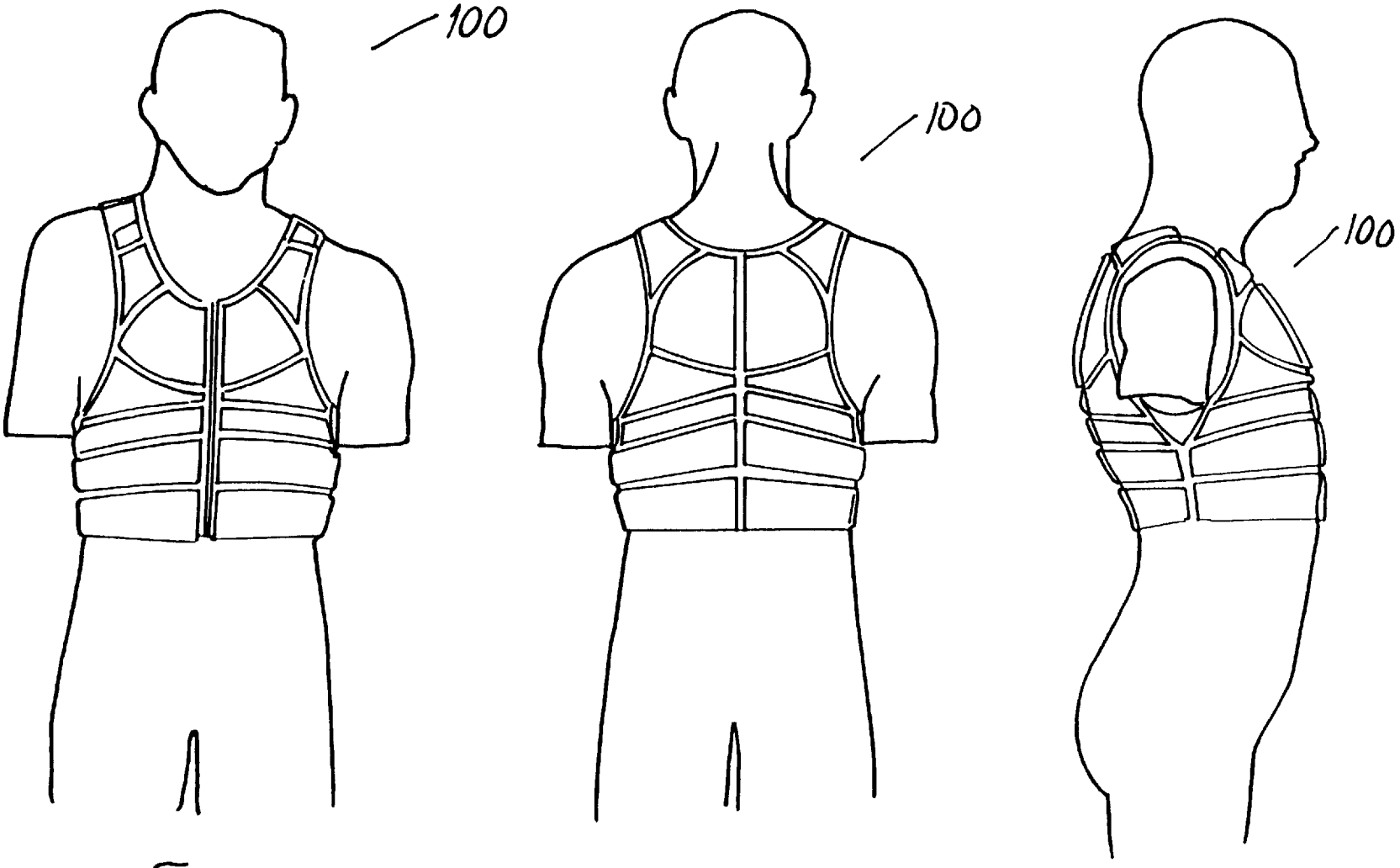
FIG. 24 is a front view of a still further life-jacket.
FIG. 25 is a rear view of the life-jacket of FIG. 24.
FIG. 26 is a side view of the life-jacket of FIG. 24.

FIGS. 24 to 26 inclusive illustrate a construction of life-jacket indicated generally by the reference numeral 100.

Figure 27:
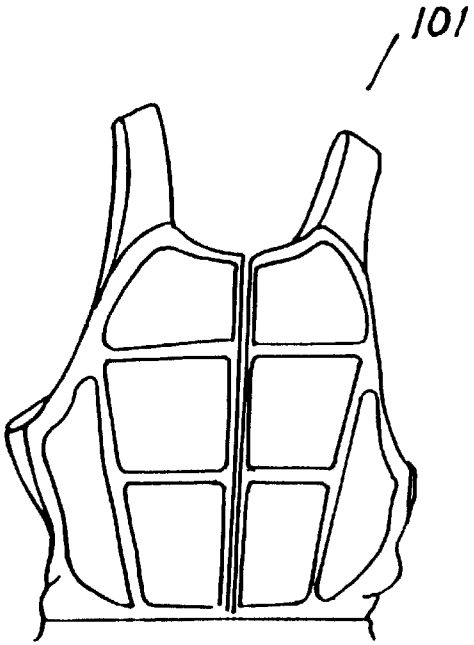

FIG. 27 illustrates another construction of life-jacket indicated by the reference numeral 101.

Figure 29:
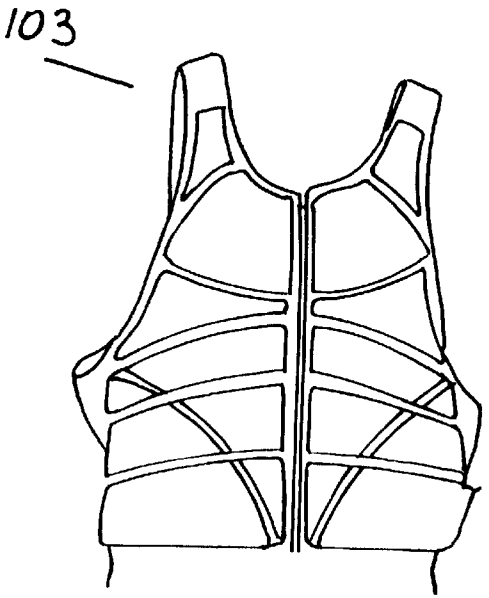
FIGS. 27 to 29 are front view of still further constructions of life-jacket.
Figure 28:
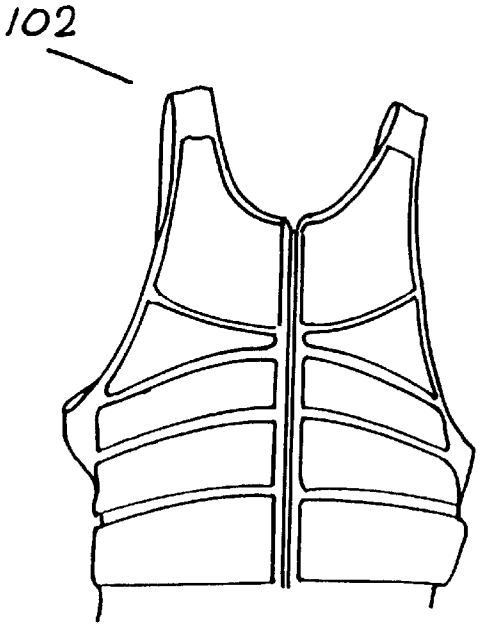

FIG. 28 illustrates an alternative construction of life-jacket indicated by the reference numeral 102 and finally FIG. 29 illustrates a still further construction of life-jacket indicated generally by the reference numeral 103. All of these constructions of life-jacket do not require any further description. The arrangement of flotation material is obvious from the drawings.

It is envisaged that full spherical shapes joined by a light web or indeed many other shapes could be used such as but not exclusively cubic; rectangular; ovoid; spherical; semi-spherical; conical; pyramidal; or truncated, spherical, semi-spherical, conical or pyramidal.

It is also envisaged that while the flotation material described above has been described as generally of a cellular plastics material, having a number of protuberances or being cut from foam material, the buoyancy material could include inflatable buoyancy units and that these inflatable buoyancy units could be automatically inflatable.

It is envisaged and must be stated quite clearly that the life-jacket described above, for example with reference to FIGS. 2 and 3, has two advantageous features namely the fact that the buoyancy in, as it were, the life-jacket proper or, more correctly, the upper body portion, is articulated corresponding to natural body articulations and that additionally it forms in effect a complete figure-hugging vest/trousers garment, often called a long-john, that these are in their own right two separate and distinct inventions. Numerous advantages would be achieved by simply providing a life-jacket of more conventional construction i.e. for upper body wear only in which the buoyancy is articulated to provide the desired boating articulation zones. Similarly, the provision of a long-john which incorporates a more conventional arrangement forming the upper body portion would be advantageous.

In particular the embodiment utilising a fastener to releasably attach and detach the upper body portion from the lower trouser portion has some very important advantages. While it can be held that the provision of a zip fastener or other fastening means allows the "life-jacket cover" to be discarded and is thus not advantageous, it has other, not necessarily obvious, advantages. Firstly, as it is not often appreciated buoyancy material deteriorates in its flotation properties over time and thus this facilitates replacement of one or other portion of the life-jacket. Secondly, in certain situations, particularly warmer climates, the long-johns may be too warm to wear on all occasions and the replacement by a pair of shorts incorporating a zip is advantageous. Thirdly and in some ways most importantly, because the life-jacket, according to the invention can now be worn with little clothing other than that for contact comfort such as a light undergarment between the user and his or her skin, a wider range of sizes and shapes of upper body portion can be provided. Indeed, it is easy to envisage customised ones. Women will obviously now experience a considerably added degree of comfort from such a situation. Users will thus be able to mix and match between upper body portion and lower trouser portion.

It is envisaged that a life-jacket according to the present invention could be provided in which the upper body garment has a base sheet of an elastic form hugging material. In this case, then the flotation material would be affixed thereto by any suitable means such as adhesive, thus, it would be possible to take somebody's ordinary garment which fitted them perfectly and to design on top of it the necessary flotation material and then to house that formed garment in another casing to provide the life-jacket and incorporate a trousers or not as the case may be.

It is further envisaged that the life-jacket according to the present invention could incorporate a collar containing buoyancy material whether inflatable or not.

The invention is not limited to the embodiments hereinbefore described which may be varied in both construction and detail.

We claim:

1. A life-jacket comprising:

an upper body garment having a front, back, waist, armpits and neck;

the garment being a double-skinned garment of two layers of material;

a plurality of pockets formed in the garment by joining the layers together;

separate buoyancy material in each pocket, the spacing between the pockets and the shape and deployment of the buoyancy material being such as to prevent undue contact between adjacent pockets on articulation; and articulation zones formed in the buoyancy material for hinging and flexing of the buoyancy material, said articulation zones being coincident with the articulation zones of a wearer's upper torso during specified boating activities;

the garment being a figure hugging elasticized garment, the buoyancy material being directly affixed thereto.

2. A life-jacket as claimed in claim 1 in which the garment is a vest-like, sleeveless garment having a closable front opening and comprising in the front on each side of the opening:

a pair of lower pockets spaced apart from each other, adjacent, above and across the waist to define with the waist, a waist articulation zone;

a pair of intermediate pockets spaced apart from each other and across and apart from the lower pockets and extending towards the armpits to define with the lower pockets an underneath ribs articulation zone;

a pair of spaced apart chest pockets above and spaced apart from the intermediate pockets to define with the intermediate pockets a mid-ribs to armpits articulation zone;

a shoulder pocket above and spaced apart from the chest pockets to define with the chest pockets a below collar bone to armpits articulation zone and with the neck a top of the shoulder articulation zone; and the spacing between each pair of lower pockets, intermediate pockets and chest pockets together forming an intermediate twist articulation zone.

3. A life-jacket as claimed in claim 2 in which the garment additionally has a back comprising:

a pair of lower back pockets spaced apart from each other, adjacent above and across the waist portion to define with the waist a back of the waist articulation zone;

a pair of intermediate back pockets spaced apart from each other, adjacent above and apart from the lower back pockets and defining with the lower pockets a mid-back articulation zone;

a pair of upper back pockets spaced apart from each other adjacent above and apart from the intermediate back pockets and defining with the intermediate back pockets a shoulder articulation zone and with the neck of the garment a neck articulation zone; and the spacing between each pair of lower back pockets, intermediate back pockets and upper back pockets defining a spine articulation zone.

4. A life-jacket as claimed in claim 1 in which the garment is a vest-like front opening sleeveless garment comprising on the front on each side of the opening:

a lower pocket spaced apart from, adjacent and across the waist to define with the waist, a waist articulation zone;

an intermediate pocket spaced apart from, above and across the lower pocket and extending towards the armpits to define with the lower pocket an underneath ribs articulation zone;

a chest pocket above and spaced apart from the intermediate pocket to define with the intermediate pocket a mid-ribs to armpits articulation zone;

a shoulder pocket above and spaced apart from the chest pocket to define with the chest pocket a below collar bone to armpits articulation zone and with the neck a top of the shoulder articulation zone.

5. A life-jacket as claimed in claim 4 in which the garment additionally has a back comprising:

a lower back pocket adjacent above and across the waist to define with the waist a back of the waist articulation zone;

an intermediate back pocket adjacent above and across the lower back pocket to define with the lower back pocket a mid-back articulation zone; and an upper back pocket adjacent above and across the intermediate back pocket to define with the intermediate back pocket a shoulder articulation zone and with the neck of the garment a neck articulation zone.

6. A life-jacket as claimed in claim 1 in which the buoyancy material comprises a base sheet carrying a plurality of separate protuberances of buoyancy material.

7. A life jacket as claimed in claim 6 in which the protuberances are formed of one or more sizes and are of any regular shape such as: cubic; rectangular; ovoid; spherical; semi-spherical; conical; pyramidal; or truncated, spherical, semi-spherical, conical or pyramidal.

8. A life-jacket as claimed in claim 6, wherein the base sheet and the protuberances are made of the same material.

9. A life-jacket garment comprising:

an upper body portion having a front, back, waist, armpits and neck;

the garment being a double-skinned garment of two layers of material;

a plurality of pockets formed in the garment by joining the layers together;

separate buoyancy material in each pocket, the spacing between the pockets and the shape and deployment of the buoyancy material being such as to prevent undue contact between adjacent pockets on articulation;

articulation zones formed in the buoyancy material for hinging and flexing of the buoyancy material, said articulation zones being coincident with the articulation zones of a wearer's upper torso during specified boating activities;

a lower trouser portion integral with the upper body portion; and wearer protection pads included in the garment incorporating a foam material and articulation joints formed by stitching parallel to the desired hinge movement.

10. A life-jacket as claimed in claim 9 in which the upper body portion and the lower trouser portion are releasably attached at a waist portion.

11. A sailing suit comprising a life-jacket having:

an upper body garment having a front, back, waist, armpits and neck;

buoyancy material contained in the garment;

a lower trousers having a seat portion and a pair of leg parts, the lower trousers having a waist formed by the waist of the upper body garment; and an overjacket having:

a front and a back having additional material to form a shelf to accommodate the upper body garment.

12. A sailing suit as claimed in claim 11 in which the overjacket comprises:

a front closing and opening means;

a collar of elastic water sealing material having releasable connection means to form a tubular neck hugging seal, capable of folding in on itself;

sleeves terminating in wrist portions of elastic water sealing material, the sleeves being cut so as to lie when laid out flat above and beyond on either side of the collar;

a pouch of flexible material having an openable and closable downwardly directed mouth, the pouch being secured along one seam to the back of the overjacket below the collar; and a head protecting hood stored within the pouch and connected thereto.

13. A method of making a life-jacket comprising the steps of:

identifying appropriate articulation zones for a specific boating activity for a particular size of user;

preparing a pattern to allow the cutting of an upper body garment;

marking the articulation zones on the pattern;

preparing suitable buoyancy material;

cutting out the upper body garment;

partially making up the garment;

adding the buoyancy material, taking due account of the articulation zones; and finishing a particular size of the garment for the particular size of user and the specific boating activity.

14. A method of making a life-jacket as claimed in claim 13 in which the upper body garment is formed from an upper body base vest of elasticised material for wear close to the user's skin and in which the buoyancy material is directly affixed thereto.

15. A method as claimed in claim 13 in which there is carried out the steps of:

part forming an upper body garment with an open back pockets and two open front pockets;

forming a buoyancy panel for each pocket, each panel having a base sheet with buoyancy material affixed thereto defining appropriate articulation zones for the specific pocket;

inserting the buoyancy panel into each pocket;

securing the buoyancy panels within each pocket; and finishing the life-jacket.

16. A life-jacket comprising:

an upper body garment having a front, back, waist, armpits and neck;

buoyancy material contained in the garment;

articulation zones formed in the buoyancy material for hinging and flexing of the buoyancy material, said articulation zones being coincident with the articulation zones of a wearer's upper torso during specified boating activities; and the garment including a figure hugging elasticized garment in which the buoyancy material is directly affixed thereto.

17. A life-jacket comprising:

an upper body garment having front, back, waist, armpits and neck;

buoyancy material contained in the garment;

articulation zones formed in the buoyancy material for hinging and flexing of the buoyancy material, said articulation zones being coincident with the articulation zones of a wearer's upper torso during specified boating activities;

a lower trouser portion integral with the upper body garment; and wearer protection pads incorporating a foam material and suitable articulation joints formed by stitching parallel to the desired hinge movement.

18. A method of making a life-jacket comprising the steps of:

identifying appropriate articulation zones for a specific boating activity for a user;

preparing a pattern to allow the cutting of an upper body garment;

marking the articulation zones on the pattern;

preparing suitable buoyancy material;

cutting out the upper body garment;

partially making up the garment;

adding the buoyancy material, taking due account of the articulation zones;

forming the upper body garment from an upper body base vest of elasticized material for wear close to the user's skin and in which the buoyancy material is directly affixed thereto; and finishing the garment.

* * * * *